US010852085B2

(12) United States Patent
Cleary et al.

(10) Patent No.: US 10,852,085 B2
(45) Date of Patent: Dec. 1, 2020

(54) DELINKER MECHANISM FOR CHAIN-DRIVEN MACHINE GUN

(71) Applicants: Michael Morency Cleary, Carpinteria, CA (US); James M Cleary, Sherman Oaks, CA (US)

(72) Inventors: Michael Morency Cleary, Carpinteria, CA (US); James M Cleary, Sherman Oaks, CA (US)

( * ) Notice: Subject to any disclaimer, the term of this patent is extended or adjusted under 35 U.S.C. 154(b) by 0 days.

(21) Appl. No.: 16/511,875

(22) Filed: Jul. 15, 2019

(65) Prior Publication Data

US 2020/0096270 A1 Mar. 26, 2020

Related U.S. Application Data

(63) Continuation-in-part of application No. 16/378,264, filed on Apr. 8, 2019, now abandoned, which is a continuation of application No. 16/101,493, filed on Aug. 12, 2018, now abandoned, which is a continuation-in-part of application No. 15/887,111, filed on Feb. 2, 2018, now abandoned.

(60) Provisional application No. 62/453,692, filed on Feb. 2, 2017.

(51) Int. Cl.

| | |
|---|---|
| ***F41A 7/08*** | (2006.01) |
| ***F41A 9/31*** | (2006.01) |
| *F41A 17/18* | (2006.01) |

(52) U.S. Cl.

CPC ..... *F41A 9/31* (2013.01); *F41A 7/08* (2013.01); *F41A 17/18* (2013.01)

(58) Field of Classification Search

CPC ..... F41A 9/31; F41A 7/08; F41A 17/18

USPC ..... 89/33.25

See application file for complete search history.

(56) References Cited

U.S. PATENT DOCUMENTS 2,375,219 A * 5/1945 Gentry ..... F41A 9/30 89/33.25

2,388,291 A * 11/1945 Ruger ..... F41A 5/18 89/33.25

(Continued)

OTHER PUBLICATIONS

Microsoft's Sculpt Ergonomic Keyboard, webpage https://marco.org/2013/08/30/sculpt-ergonomic-keyboard-review, downloaded Apr. 25, 2017.

(Continued)

*Primary Examiner* — Samir Abdosh

(74) *Attorney, Agent, or Firm* — Guy Cumberbatch

(57) ABSTRACT

A compact 50 caliber machine gun system which utilizes an original Browning rear-stripping ammunition link design. The chain-driven machine gun system features a delinker assembly configured to receive a belt of linked cartridges, separate each of the cartridge from the belt rearwardly, and feed each of the cartridges for firing. The delinking function is separated from the motion of the bolt assembly so as to reduce the overall length of the gun system. The receiver has a receiver mounting length RML from the rear base of each incoming cartridge in a belt of connected links to the rear end of the receiver that is less than 15 inches. A shuttle feed system is incorporated into the basic chain gun style mechanism which had been limited to a sprocket feed on all previous designs. An electronic anti-hangfire system uses a single proximity switch and the already existing parts and motions of the gun.

22 Claims, 35 Drawing Sheets

(56) References Cited

U.S. PATENT DOCUMENTS

| | | | | | |
|---|---|---|---|---|---|
| 2,436,370 | A * | 2/1948 | Alexander | F41A 9/30 | 89/33.25 |
| 2,972,286 | A * | 2/1961 | Marquardt | F41F 1/08 | 89/126 |
| 2,993,414 | A * | 7/1961 | Woodman | F41A 9/31 | 89/33.25 |
| 3,834,272 | A * | 9/1974 | Patenaude | F41F 1/10 | 89/12 |
| 4,038,904 | A * | 8/1977 | Rocha | F41A 9/31 | 89/33.03 |
| 4,301,709 | A * | 11/1981 | Bohorquez | F41A 17/18 | 89/11 |
| 4,418,607 | A * | 12/1983 | Price | F41A 9/30 | 89/11 |
| 4,481,858 | A * | 11/1984 | Price | F41A 9/30 | 89/11 |
| 4,563,936 | A | 1/1986 | Cleary | | |
| 4,587,879 | A * | 5/1986 | Savioli | F41A 9/55 | 89/33.04 |
| 9,618,284 | B1 * | 4/2017 | Hoffman | F41A 3/66 | |
| 9,638,483 | B1 * | 5/2017 | Hoffman | F41A 3/14 | |
| 9,702,649 | B1 * | 7/2017 | Hoffman | F41A 3/14 | |
| 10,352,638 | B1 * | 7/2019 | Day | F41A 9/38 | |
| 2011/0290103 | A1 * | 12/2011 | Herrmann | F41A 9/51 | 89/18 |
| 2019/0339034 | A1 * | 11/2019 | Day | F41A 9/32 | |
| 2020/0096270 | A1 * | 3/2020 | Cleary | F41A 9/31 | |

OTHER PUBLICATIONS

Custom Keyboard for Apple products, webpage—https://developer.apple.com/library/content/documentation/General/Conceptual/ExtensibilityPG/CustomKeyboard.html, downloaded Apr. 25, 2017.

Custom Keyboard for Android products, webpage—https://code.tutsplus.com/tutorials/create-a-custom-keyboard-on-android--cms-22615, downloaded Apr. 25, 2017.

Coding-Keyboard-App, Google Play Store entry—https://play.google.com/store/apps/details?id=com.gazlaws.codeboard&hl=en, downloaded Apr. 24, 2017.

Toms_Guide-best-android-keyboards, webpage—https://www.tomsguide.com/us/pictures-story/403-best-android-keyboard-apps.html#s17, available Jul. 29, 2017.

* cited by examiner

CHAIN GUN

BROWNING M2

BOLT AND CARRIER MOVE FREELY TO REAR UNLOCKING BOLT AND DELINKER COLLAR IS PICKED UP BY CARRIER TOWER

AT THIS TIME THE DELINKER ROUND IS ROTATED BY THE ROTOR AND GENEVA DRIVE TO THE BOLT FACE TO BE CHAMBERED AND FIRED

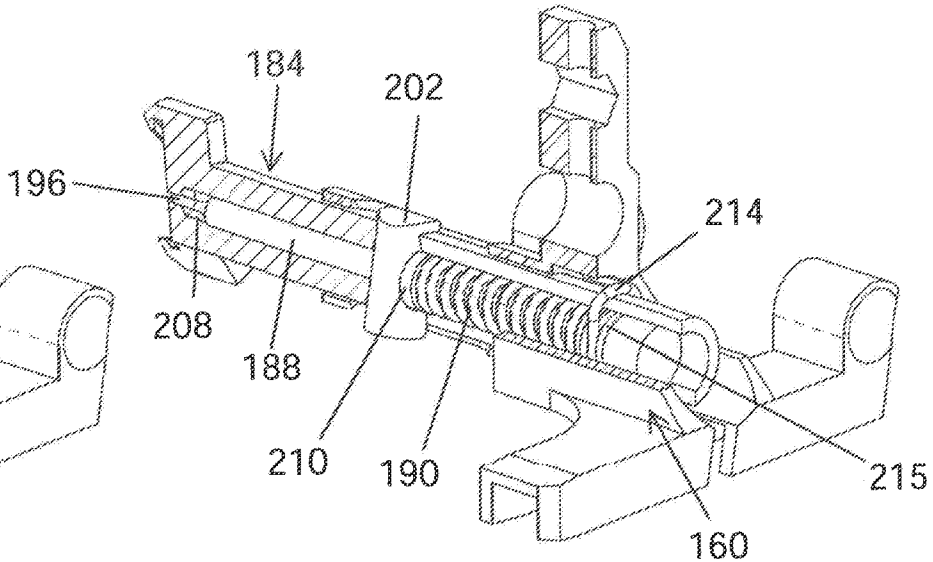
Fig. 19B
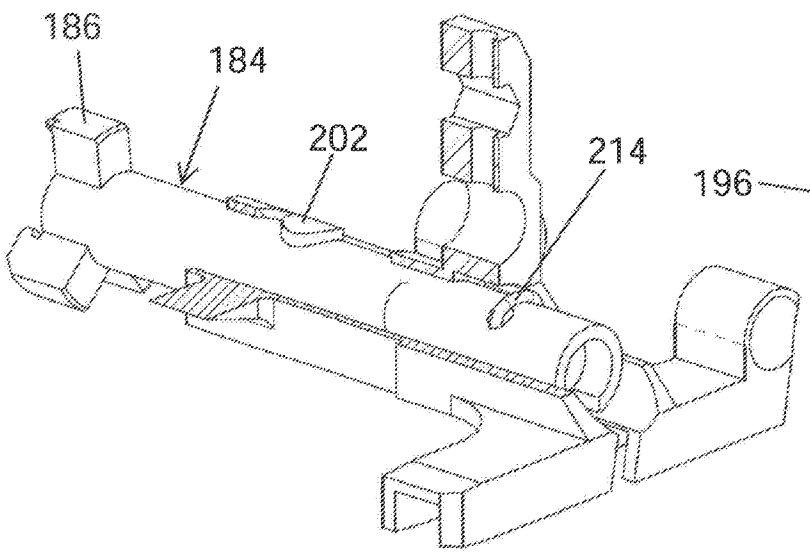
Fig 19A
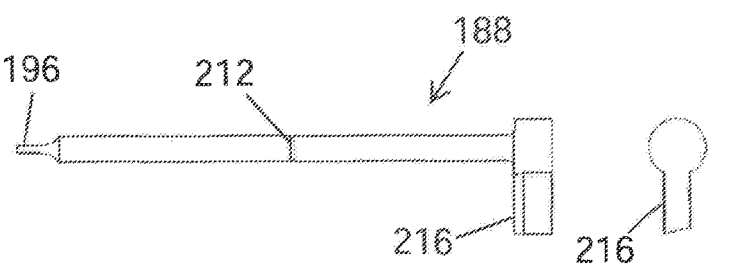
Fig. 20C
Fig. 20D
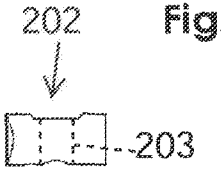
Fig. 20F
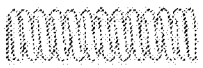
Fig. 20E
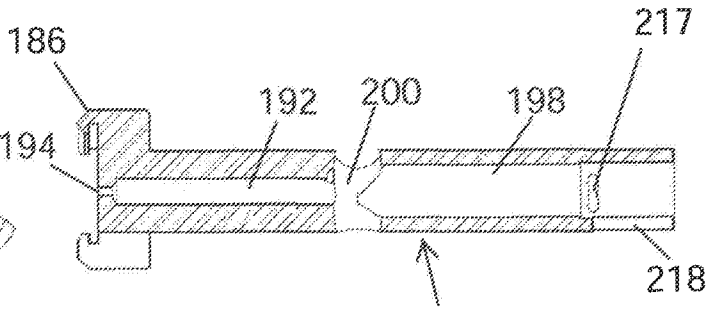
Fig. 20A
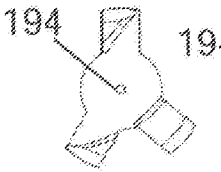
Fig. 20B

DELINKER MECHANISM FOR CHAIN-DRIVEN MACHINE GUN

RELATED APPLICATIONS

The present application is a continuation-in-part of U.S. application Ser. No. 16/378,264, filed Apr. 8, 2019, which is a continuation of U.S. application Ser. No. 16/101,493, filed Aug. 12, 2018, which is a continuation-in-part of U.S. application Ser. No. 15/887,111, filed Feb. 2, 2018, which claims priority under 35 USC § 119 to U.S. Provisional Application Ser. No. 62/453,682, filed Feb. 2, 2017, the entire disclosures of which are expressly incorporated herein.

FIELD OF THE INVENTION

The present invention is directed to a compact 50 caliber chain-driven machine gun system which utilizes an original Browning rear-stripping ammunition link design.

BACKGROUND OF THE INVENTION

Almost 100 years ago Mr. John Browning invented a series of Machine Guns which are still in use today. They were made in multiple calibers but the functioning of the mechanism was essentially identical across the series. The original intended use for them was as a TriPod ground mounted Infantry System. Over the years however these weapons were adapted to many other uses. From airplanes and ships and on top of tanks and trucks and jeeps. One of the most successful of these weapons is the 0.50 Cal BRG MG which is sometimes called the Ma Duce or M2 50 Cal. While the other Brownings have become obsolete and have been replaced by newer mechanisms and cartridges, the Ma Duce soldiers on. The reasons are first the potency of the round of ammunition and also the fact that it is in use by so many armed forces. Literally hundreds of millions of packed and linked rounds are in the inventory of armies around the world. In spite of this huge success there is one place where the Ma Duce has never been used successfully—as an enclosed mount on tanks and armored vehicles. The Browning 0.50 Cal just does not fit in those cramped and enclosed spaces, its receiver is just too long due to the rear-stripping action of the cartridge delinker. When applied to these types of vehicles it is always mounted externally on a post mount where the gunner is mortally exposed to enemy fire. Additionally, the gun and ammunition are vulnerable to all sorts of damage, from tree branches to artillery fragments and small arms fire.

Chain-driven automatic guns include an ammunition feed and delinker system that receives an ammunition belt of linked cartridges, sequentially separates or "delinks" the cartridges from the ammunition belt, and feeds the cartridges to the gun for firing. Reliability and controllability are the advantages of chain-driven weapons over their recoil-actuated counterparts. Recoil-actuated firearms depend upon the sometimes unreliable firing of a cartridge to power the cycle of action, whereas a chain-driven gun uses an electric motor to drive a chain that moves in a rectangular circuit via four sprockets that apply tension to the chain. One link of the chain is connected to the bolt assembly, moving it back and forth to load, fire, extract, and eject cartridges. One previous example of such a gun is described in U.S. Pat. No. 4,418,607, entitled "Single Barrel Externally Powered Gun," which is incorporated herein by reference.

The existing 0.50 caliber ammunition metallic "linked" belt is derived from the original cloth belt of the World War I era which was composed of two parallel cloth straps sewn together in which a series of pockets were formed so that rounds could be inserted along the length of the belt. The cartridges were pulled to the rear to remove them from the belt and then fed into the gun mechanism. Later the cloth was replaced by metal links but the cartridges were still removed to the rear. The function of removing the cartridge to the rear is the reason for the Browning's long receiver and its difficult vehicle mounting.

Several manufacturers have tried to fill this void with a 0.50 Cal gun designed for vehicle use but all have missed the mark for the same reason. They are all designed around a side stripping link instead of using the rear-stripping link that is already on those millions of rounds in the inventories around the world. Side stripping mechanisms separate cartridges laterally from the ammunition belt rather than pulling it rearward. Most modern ammunition links are either side stripping or forward stripping which allows for a much shorter bolt stroke and therefore a much more compact receiver and feeder assembly. The challenge is to approach that same compact shape while still using the original Browning rear-stripping link design to take advantage of the large number of 0.50 Cal ammunition belts in inventories around the world.

SUMMARY OF THE INVENTION

It is an object of the present invention to provide an improved chain driven machine gun that can first strip a linked cartridge axially to the rear from an ammunition belt link, as opposed to side stripping. A secondary object provides an improved and simplified electric anti-hangfire system.

The improved 50 caliber chain-driven gun of the present invention provides a number of advantages over prior art in that the improved design allows for rear extraction of rounds from the links, significantly shorter receiver for easier turret mounting, and simplified anti-hangfire protection. The chain-driven machine gun system features a delinker assembly configured to receive a belt of linked cartridges, separate each of the cartridge from the belt rearwardly, and feed each of the cartridges for firing. The delinking function is separated from the motion of the bolt assembly so as to reduce the overall length of the gun system. The receiver has a receiver mounting length RML from the rear base of each incoming cartridge in a belt of connected links to the rear end of the receiver that is less than 15 inches. A shuttle feed system is incorporated into the basic chain gun style mechanism which had been limited to a sprocket feed on all previous designs. An electronic anti-hangfire system uses a single proximity switch and the already existing parts and motions of the gun.

An exemplary rearward-stripping externally-powered gun disclosed herein comprises a receiver at the rear end of a longitudinal barrel, the receiver being configured to laterally receive a plurality of cartridges held within a series of connected links with a rear base of the cartridges facing to the rear. The receiver includes a motor and motor drive system, and a bolt carrier driven longitudinally forward and rearward by the motor drive system, the bolt carrier having a longitudinal tube and tower extending perpendicularly away from the tube. A bolt positioned within the longitudinal tube of the bolt carrier has a forward end with a cartridge grasper adapted to engage the rear base of a cartridge, the bolt being aligned with a breech and chamber of the barrel.

A feed shuttle is adapted to translate the laterally through the receiver. A delinker shaft arranged in the receiver to translate longitudinally toward and away from the feed shuttle has a forward end adapted to engage the rear base of a cartridge and remove one cartridge at a time from the connected links. The delinker shaft passes through a bore in the bolt carrier tower, wherein the delinker shaft is coupled by a lock member to periodically translate with the bolt carrier tower. A feed rotor is arranged to rotate about a longitudinal axis and transfer a cartridge from a delinked position engaged with the delinker shaft to a load position, whereby the cartridge is engaged by the cartridge grasper of the bolt. A feed rotor drive system driven by the motor drive system periodically rotates the feed rotor to transfer a cartridge from the delinked position to the load position. Finally, the motor drive system is configured to translate the bolt carrier forward until the delinker shaft is in position to engage the rear base of a cartridge, at which point the lock member decouples further forward translation of the bolt carrier from the delinker shaft, and the bolt carrier continues forward to displace the bolt and a cartridge engaged thereby forward and deliver the cartridge to the chamber to be fired.

A method of operating a rearward-stripping externally-powered gun is disclosed. The gun has a receiver at the rear end of a longitudinal barrel, the receiver having a motor and motor drive system and being configured to laterally receive a plurality of cartridges held within a series of connected links with a rear base of the cartridges facing to the rear. A bolt carrier is driven longitudinally forward and rearward by the motor drive system, the bolt carrier having a longitudinal tube and tower extending perpendicularly away from the tube. A bolt is positioned within the longitudinal tube of the bolt carrier and has a forward end with a cartridge grasper adapted to engage the rear base of a cartridge, the bolt being aligned with a breech and chamber of the barrel. Cartridges are translated laterally through the receiver, while a delinker shaft translates longitudinally toward and away from the cartridges held within the connected links. The delinker shaft has a forward end adapted to engage the rear base of a cartridge and remove one cartridge at a time from the connected links. The delinker shaft passes through a delinker bore in the bolt carrier tower, and is coupled by a lock member to periodically translate with the bolt carrier tower. The method includes rotating a feed rotor about a longitudinal axis and transferring a cartridge from a delinked position engaged with the delinker shaft to a load position whereby the cartridge is engaged by the cartridge grasper of the bolt. The bolt carrier is translated forward until the delinker shaft is in position to engage the rear base of a cartridge, whereby the lock member decouples further forward translation of the bolt carrier from the delinker shaft, and the bolt carrier continues forward to displace the bolt and a cartridge engaged thereby forward and deliver the cartridge to the chamber to be fired.

Another method of operating the rearward-stripping externally-powered gun is provided, comprising driving a bolt carrier longitudinally forward and rearward with the motor drive system, the bolt carrier carrying a bolt having a forward end with a cartridge grasper adapted to engage the rear base of a cartridge, the bolt being aligned with a breech and chamber of the barrel. Translating the cartridges laterally through the receiver, and translating a delinker shaft longitudinally forward and rearward with the bolt carrier. The delinker shaft has a forward end adapted to engage the rear base of a cartridge and remove one cartridge at a time from the connected links when translated rearward. The delinker shaft is coupled by a movable lock member to periodically translate with the bolt carrier, wherein the bolt carrier translates the delinker shaft forward until the delinker shaft is in position to engage the rear base of a cartridge, whereby the lock member moves and decouples further forward translation of the delinker shaft from the bolt carrier, and the bolt carrier continues forward to displace the bolt and a cartridge engaged thereby forward and deliver the cartridge to the chamber to be fired. The method also includes periodically rotating a feed rotor about a longitudinal axis with the motor drive system, the feed rotor being configured to transfer a cartridge from a delinked position engaged with the delinker shaft to a load position whereby the cartridge is engaged by the cartridge grasper of the bolt.

One object of the application is a controllable delinker that allows for the delinking function to be separated from the motion of the bolt assembly so as to reduce the overall length of the gun system.

An improved chain-driven machine gun disclosed herein comprises a delinker assembly configured to receive a belt of linked cartridges, separate each of the cartridge from the belt rearwardly, and feed each of the cartridges for firing.

A further object is a delinker system that is controllably detached from the rest of the mechanism so as to reduce its required travel and permit shortening the overall size of the associated gun mechanism.

Another object is a shuttle feed system incorporated into the basic chain gun style mechanism, which previously had been limited to a sprocket feed on all previous designs An object is also incorporation of a shuttle feed heretofore associated with self-powered guns to the mechanism of a "chain gun" style weapon An improved chain gun anti-hangfire mechanism utilizes an electronic proximity sensor and a logic circuit, working in conjunction with the gun firing pin.

An electronic anti-hangfire system which uses a single proximity switch and the already existing parts and motions of the gun. The prior art required several parts, a solenoid and springs to accomplish the same function.

A further understanding of the nature and advantages of the invention will become apparent by reference to the remaining portions of the specification and drawings.

BRIEF DESCRIPTION OF THE DRAWINGS

Features and advantages of the present invention will become appreciated as the same become better understood with reference to the specification, claims, and appended drawings.

It should be noted that some Figures that depict the operation of the chain-driven automatic gun that are denoted with "A" and "B" show identical snapshots except that the "A" version is a longitudinal section while the "B" version is a cutaway perspective. In others, the "B" version has shading indicating depth features while the "A" version does not.

FIGS. 2A and 2B are front and rear perspective views of a compact 50 caliber chain-driven machine gun of the present invention with a relatively short receiver, while

FIG. 19A and 19B are cutaway perspective views of the bolt carrier showing a bolt assembly integrated therewith; and FIGS. 20A-20F are several orthogonal and sectional views of the bolt assembly and a firing pin and spring that are incorporated therein.

DETAILED DESCRIPTION OF THE PREFERRED EMBODIMENTS

The present application is directed to externally-powered automatic guns such as a chain-driven gun. Guns are broadly segregated into externally-powered or motorized guns and self-powered guns which rely on a spring recoil action or a gas spring. Externally-powered guns have a motor that drives a chain, cam or crank and connecting rod, as well as other mechanisms to engage and move the various cooperating parts (e.g., bolt and carrier) in synch. All of these will collectively be termed a "drive system" which is motor operated.

More specifically, the present application relates to an improved chain-driven automatic gun with a bolt carrier and delinker combination for rearward extraction of rounds from an ammunition belt of linked cartridges, which provides improved performance and requires less maintenance than the existing chain-driven guns. In particular, the application describes a compact 50 caliber system which utilizes an original Browning rear-stripping ammunition link design.

In most modern light machine guns the link stripping motion is performed by the bolt on its forward motion and is directly related to the total stroke of the bolt and bolt carrier. In the Chain Gun and Gatling series of machine guns, the link is stripped sideways from the link by a sprocket and then passed to the bolt by a transfer sprocket or rotor. In both of these systems the cartridge travels the stroke of the bolt. This system works well and allows mounting of the guns inside tanks or armored vehicles because of the short stroke and consequent short length of the gun. This mounting advantage, however, has not been possible for guns that rely on rearward-stripping links, like the M2 50 Cal.

According to the present invention, there is provided an improved chain driven machine gun. The gun includes five principal functional assemblies, i.e., a chain drive or bolt control assembly, a bolt assembly, a barrel assembly, a feeder assembly and a power transmission system. In its simplest form, the system is an externally powered mechanism in which the gun barrel is fixed in the sense that it does not cycle or rotate.

Figure 1:
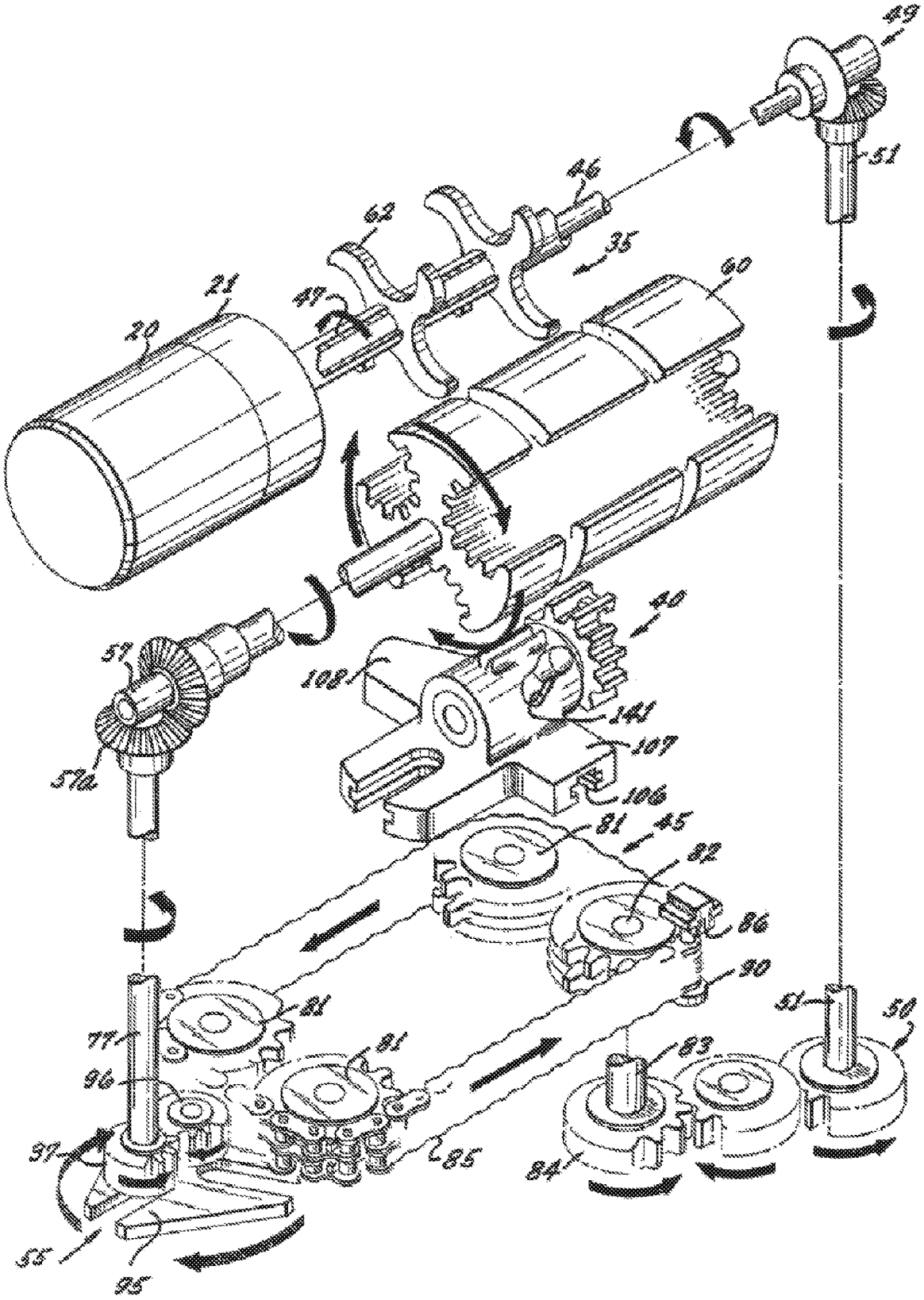
Fig. 1 (PRIOR ART)
FIG. 1 is a diagrammatic view of the interior working parts of the gun in accordance with the prior art.

FIG. 1 schematically illustrates the main components of a chain-driven delinking system when using a side-stripping ammunition belt, as in U.S. Pat. No. 4,418,607. The principal functional components of the gun include a feeder assembly generally designated 35 which cooperates with a bolt assembly 40, the latter movable by a chain cam assembly generally indicated at 45. A power transmission assembly for the synchronous movement of the various parts includes the motor 20 and gear reducer 21, the output of which drives an inner drive shaft 46 and an outer concentric shaft 47. The gear reducer 21 operates to reduce motor output speed by a factor of 2.3 to 1 to drive the inner drive shaft 46, while the outer concentrically arranged output shaft 47 is reduced by a further 16 to 1 ratio. The output of shaft 46 is the right angle bevel gear drive 49 having a 1 to 1 ratio, the bevel gears being positioned in a housing. The shaft 51 of gear set 49 connects to a set of spur gears 50 located in a gear housing. Spur gears 50 form the power source for the chain drive assembly 45 which in turn operates a Geneva gear assembly 55. In this form, the Geneva gear assembly 55 operates as a positively driven intermittent motion device to interface the constant velocity feeding with the intermittent bolt operation.

The output of the Geneva gear assembly operates a second bevel gear set 57, the output of which is connected to a feed rotor 60, the latter part of the feeder assembly. Cooperating with the feed rotor 60 is a feed sprocket generally designated 62, the latter driven by shaft 47. The outer drive shaft 47 has affixed to it the feed sprockets 62, each having four teeth, as illustrated in FIG. 1, which operate to advance a round to the feed rotor 60. Various other numbered components of the chain-driven delinking system shown in FIG. 1 are described in U.S. Pat. No. 4,418,607, expressly incorporated herein, and will not be further detailed.

Overview

Figure 2A:
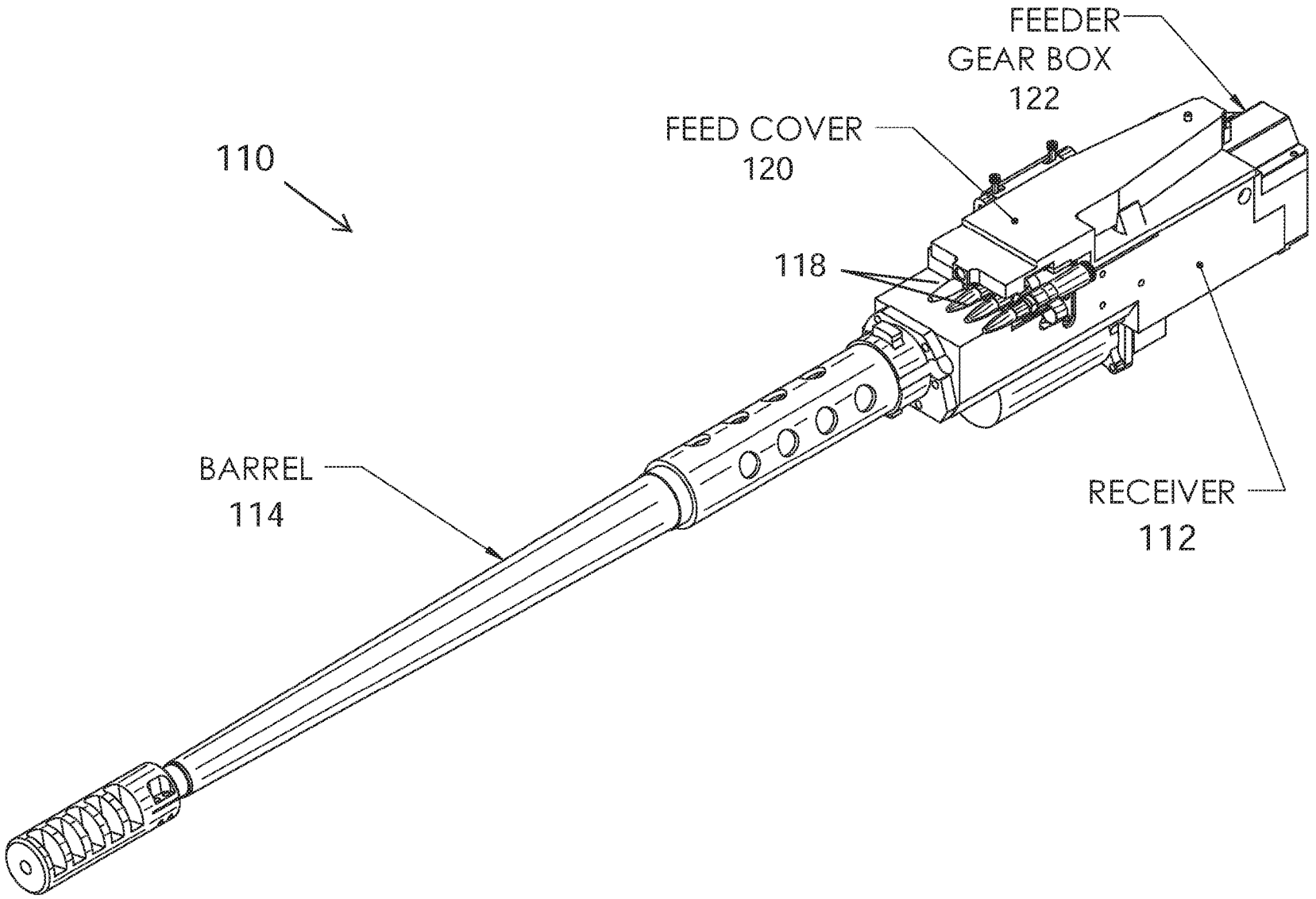
Figure 2B:
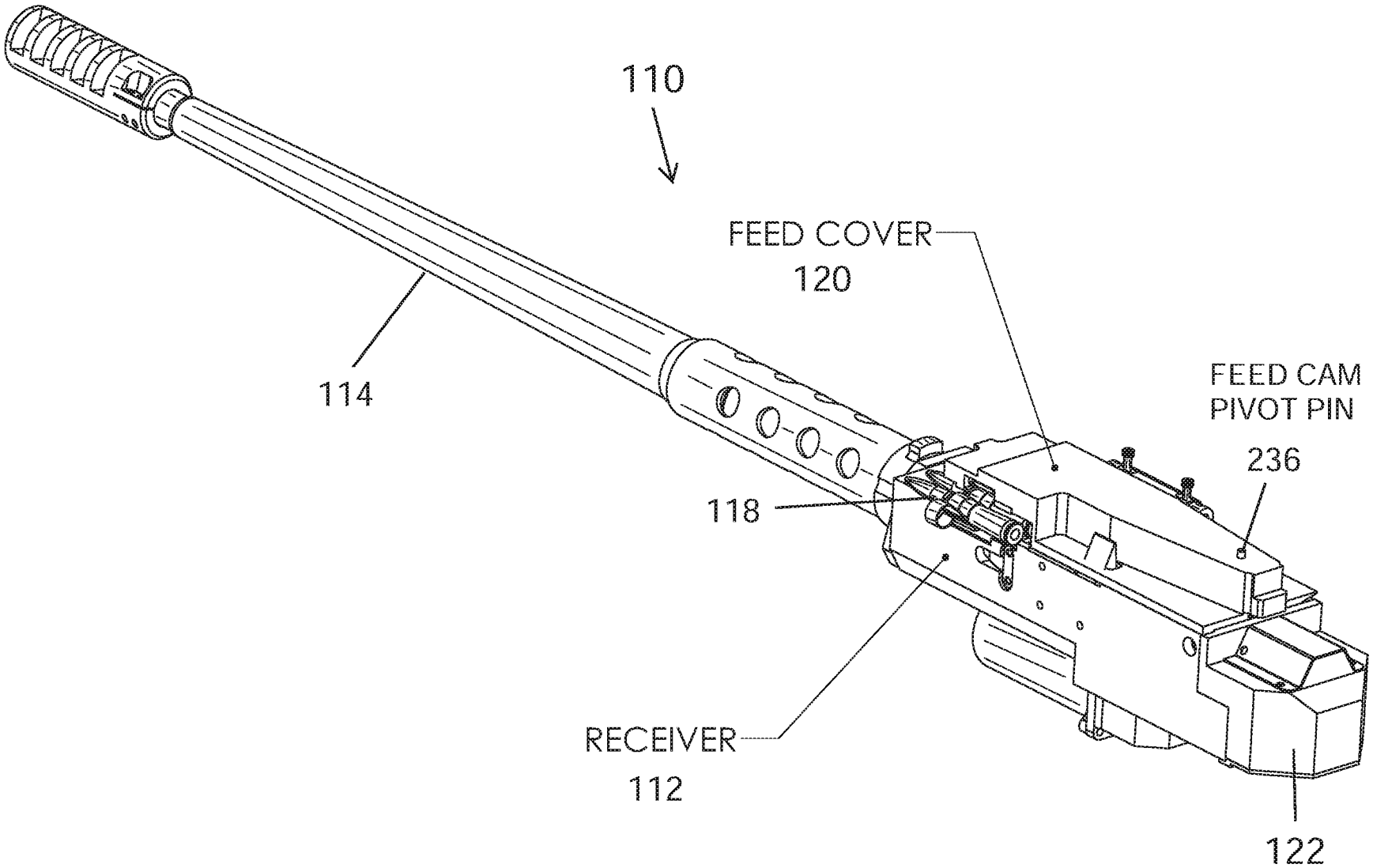
Figure 2C:
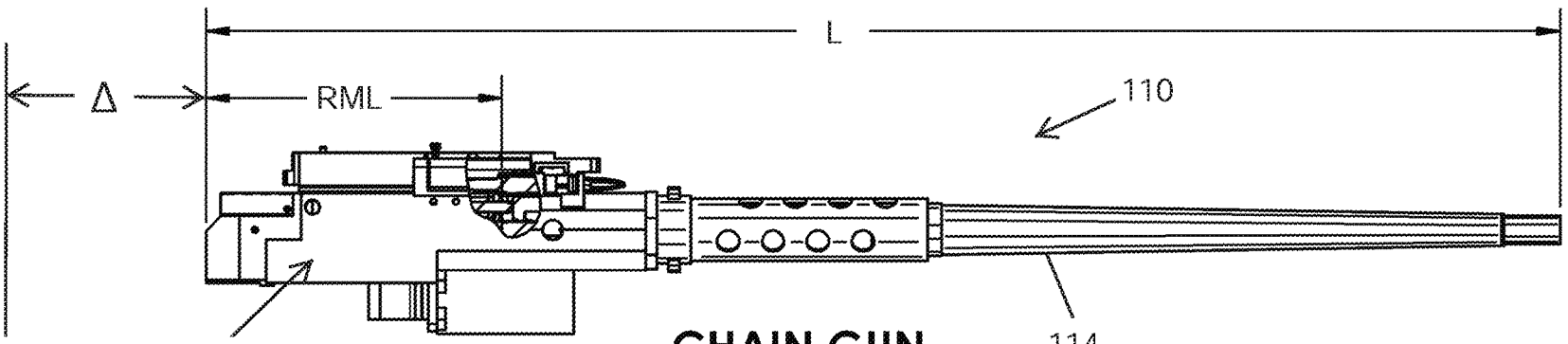
FIG. 2C is a side elevational view thereof.
Figure 3A:
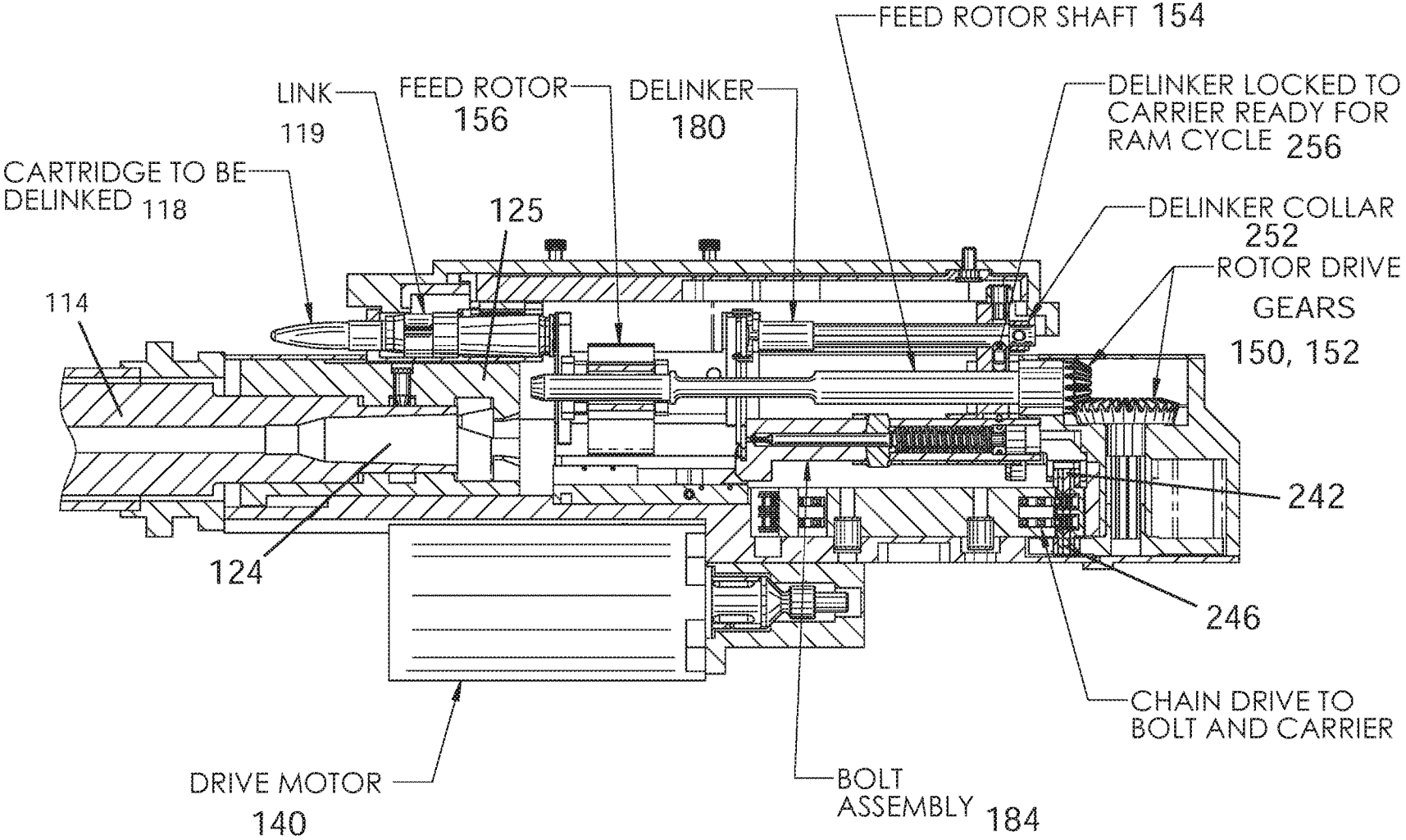
FIG. 3A is a longitudinal sectional view of the delinking and firing mechanism of the present application in an operation step of a sear position prior to delinking a 50 caliber cartridge or round.

FIGS. 2A and 2B are front and rear perspective views of a compact 50 caliber chain-driven machine gun 110 of the present invention, and FIG. 2C is a side elevational view thereof. The gun has a relatively short receiver 112 on a rear end in which a delinking and firing mechanism is housed and an elongated barrel 114. The receiver 112 is a generally rectilinear box. A series of cartridges 118 held in a flexible belt of links 119 are guided through a lateral slot above the receiver 112 by a feeder enclosed within a feed cover 120. At the rear of the receiver 112, a feeder gearbox 122 transmits power from a chain drive system (not shown) mounted in the receiver 112 to components within the receiver and feed cover 120. The end result is delinking of individual cartridges 118 as they pass over the receiver 112 and sequential rapid loading and firing of the cartridges through the barrel 114. The cartridges 118 pass laterally across a top portion of the receiver 112 and are sequentially delinked to the rear from the belt. One-by-one, the cartridges are delinked and fed into a chamber 124 defined within a rear end of the barrel 114 (FIG. 3A) of the gun for firing, then the spent cartridge case is ejected. FIG. 3A also shows a breech 125 surrounding the rear end of the barrel 114 which will be described below.

The total length L of the gun 110 as shown in FIG. 2C is typically between 55-65 inches, and in one embodiment is 60.2 inches. In the gun described herein, an axial mounting length RML defined by the receiver is preferably less than 15 inches, more preferably between 12-15 inches, and in one embodiment is 13.2 inches. The receiver mounting length RML is defined as the distance from the base or rear end of each incoming cartridge/round in the feeder of the gun to the rear end of the receiver. The reduced mounting length RML of the receiver beneficially makes it easier to mount the gun of the present application within an enclosed space on tanks and armored vehicles.

Figure 2D:
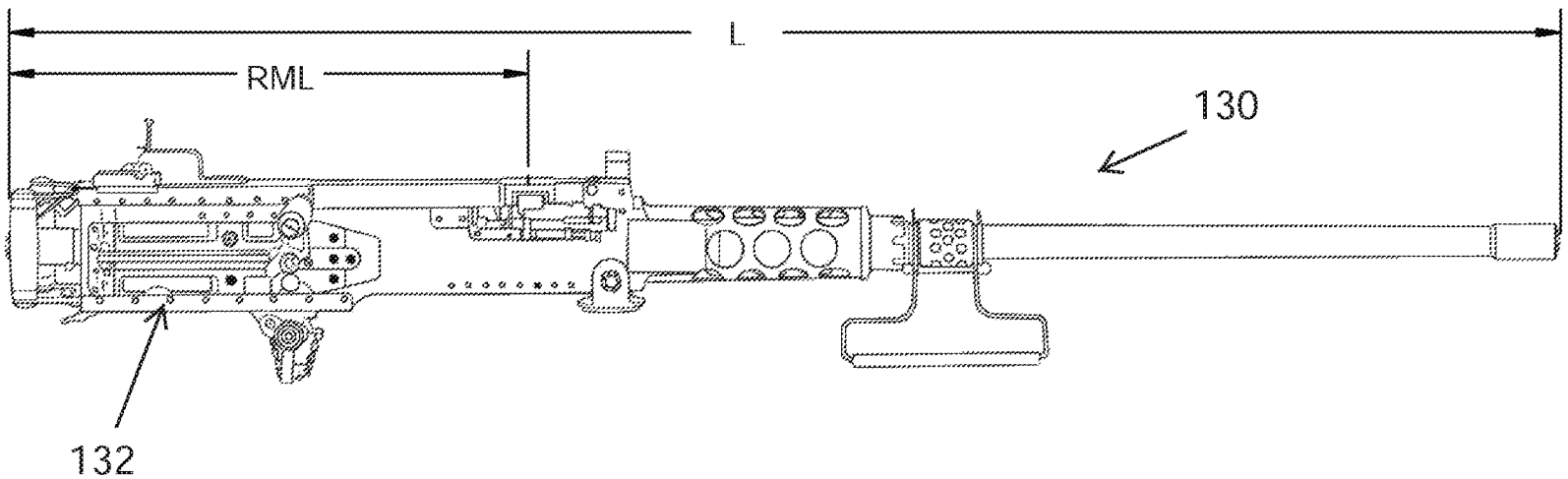
Fig. 2D (PRIOR ART)
FIG. 2D is a side elevational view of a conventional Browning 50 caliber machine gun of the prior art having a longer receiver.

FIG. 2D is a side elevational view of a conventional Browning 50 caliber machine gun 130 showing the longer receiver 132, having a receiver mounting length RML normally around 20 inches (19.8 in one specific version), for a gun having a total length L of again between 55-65 inches, usually 63 inches. The longer receiver 132 adds length which makes it challenging to mount the gun 110 within an enclosed space on tanks and armored vehicles. The reduction in the receiver mounting length RML for the two guns is indicated in FIG. 2C at A, which is between about 8-9 inches. This difference enables greater flexibility in choice when mounting the gun 110 of the present application in enclosed spaces.

FIGS. 2-13 illustrate various operational components within the receiver 112 of the chain gun 110 which enable the shorter receiver mounting length RML. The gun 110 utilizes a chain drive which may be similar to that shown and described in U.S. Pat. No. 4,418,607, or in other references, but certain functional components common to such guns are modified within the receiver 112. Namely, a delinking function which pulls individual cartridges from a link of cartridges is separated from the motion of a bolt assembly so as to reduce the overall length of the gun system, as will be described. Prior to a discussion of a sequence of operation, the main parts of the gun 110 will be identified, which parts may be seen in various of the figures in which the side of the receiver 112 has been removed for clarity.

Figure 3B:
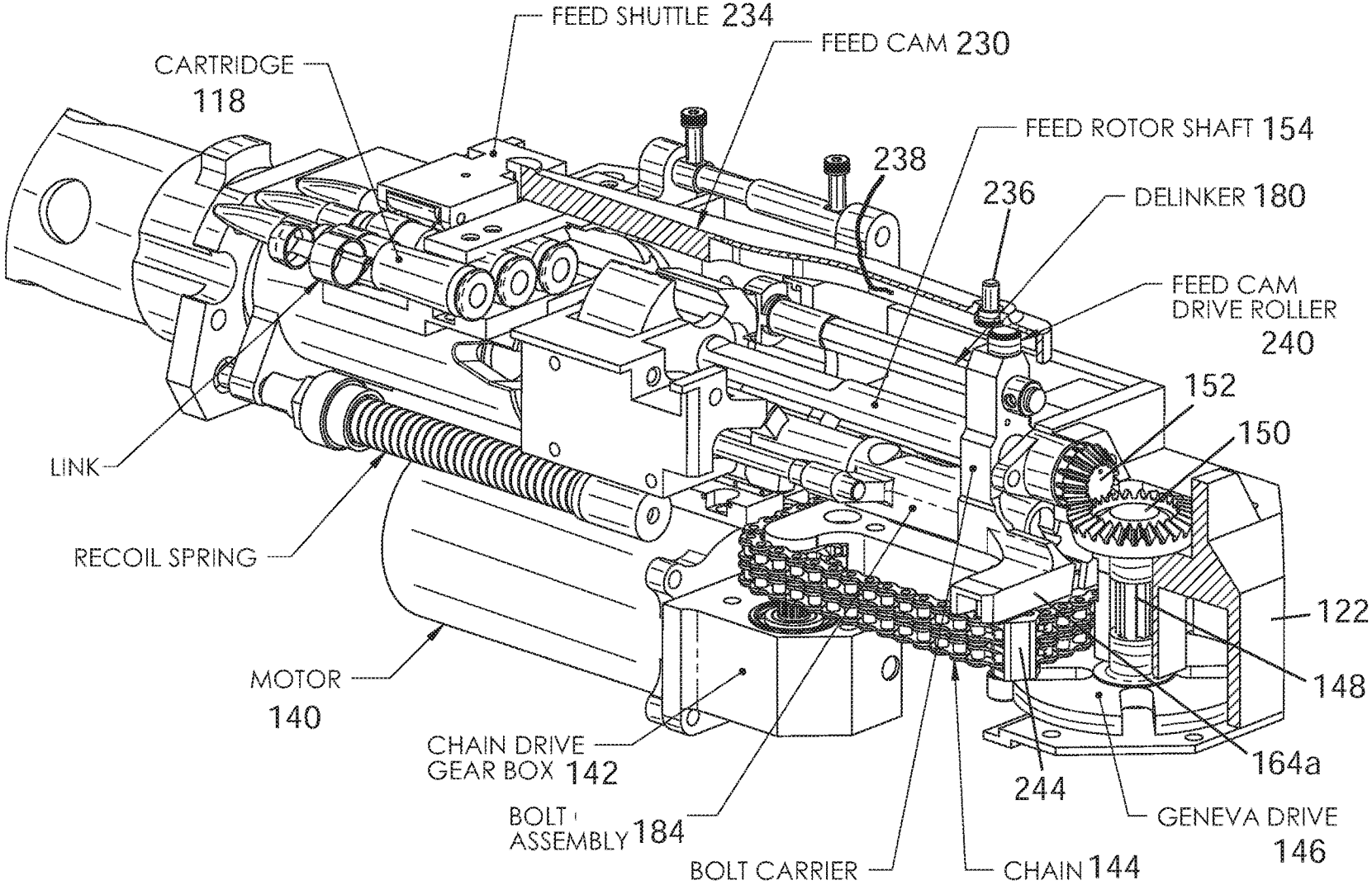
FIG. 3B is a cutaway perspective view.

As best seen in FIG. 3B, the main operational components within the receiver 112 are shown. As mentioned above, a chain drive system in the lower portion of the receiver comprises a motor 140 connected to a chain drive gearbox 142 which drives the chain 144. The chain 144 interacts with several components of the receiver, including via a vertical shaft 148 a rear Geneva Drive 146 which forms a part of the aforementioned feeder gearbox 122.

Figure 5A:
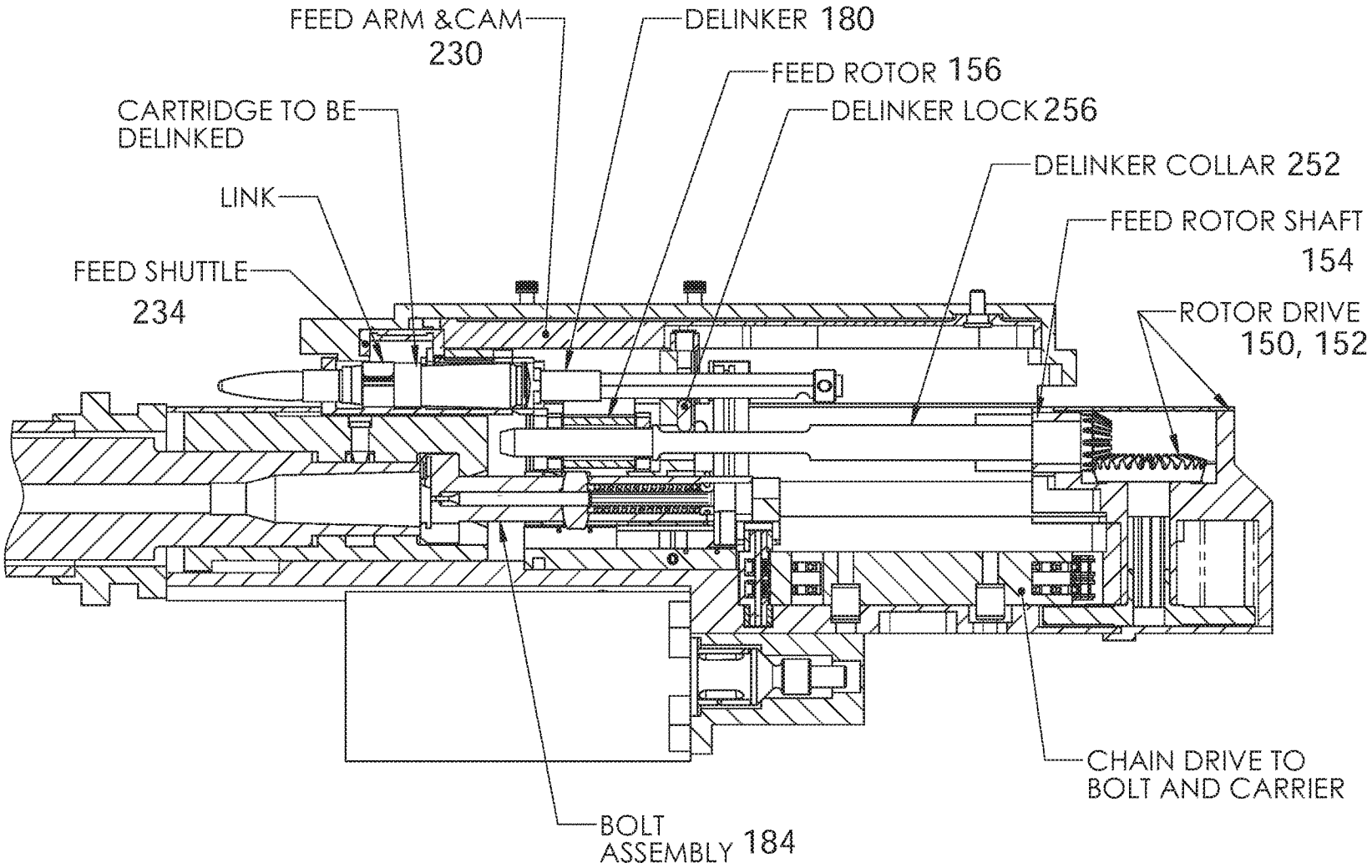
FIG. 5A is a longitudinal sectional view and FIG. 5B is a cutaway perspective view of the delinking and firing mechanism after further forward movement of the bolt assembly to the extent of its travel which cycles the feed cam and shuttle, thus moving a round into the delinker.
Figure 5B:
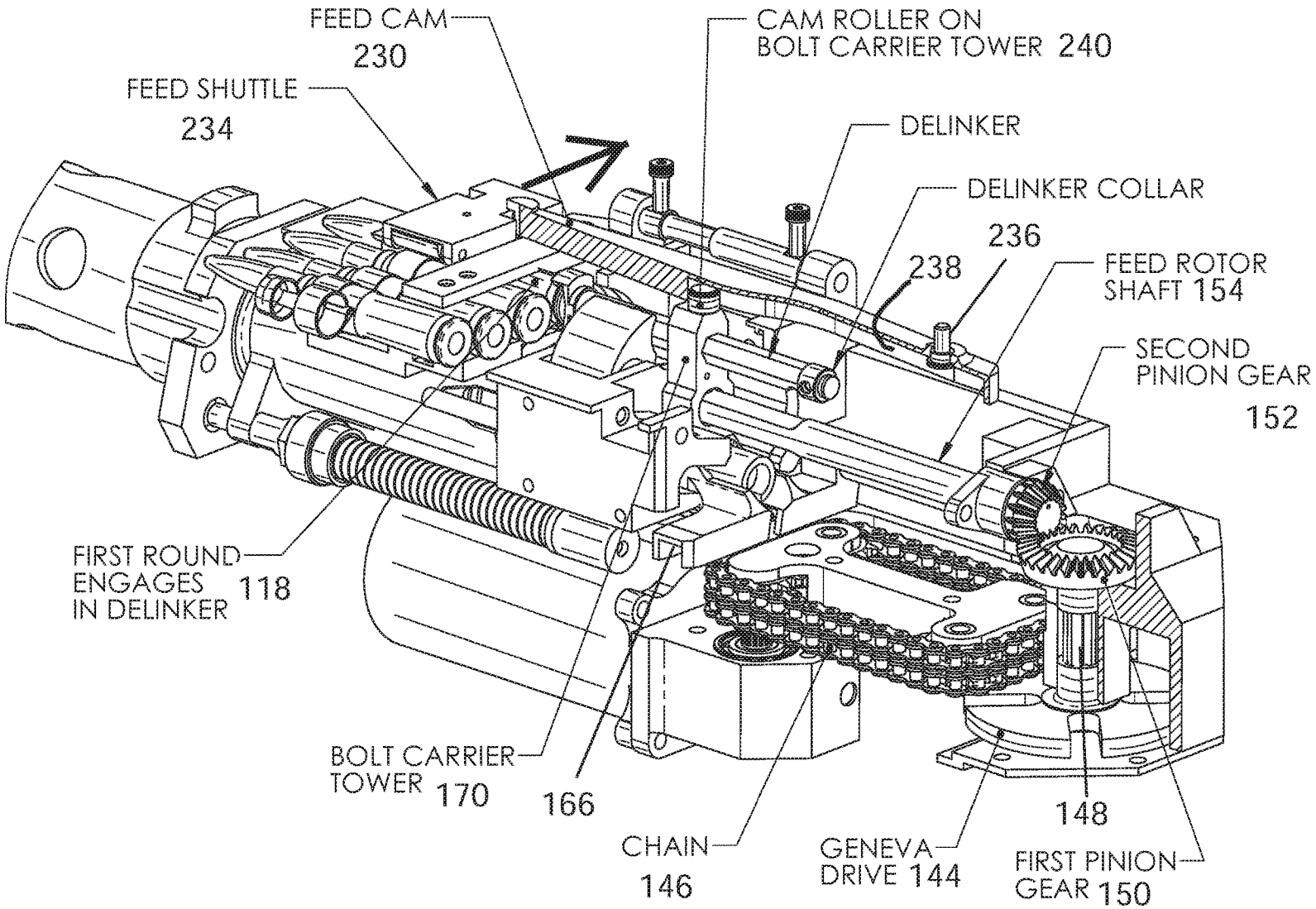

FIG. 5B shows the upstanding shaft 148 from the Geneva Drive 146 connected to rotate a first pinion gear 150 engaged with a second pinion gear 152. The axis of rotation of the first pinion gear 150 is vertical, while the second pinion gear 152 rotates along a horizontal longitudinal axis and drives a feed rotor shaft 154. The feed rotor shaft 154, in turn, rotates a feed rotor 156 which transfers the cartridges 118 from the location where they are delinked to an internal location where they may be advanced into the firing chamber and fired. As will be clear below, the feed rotor 156 carries a delinked cartridge 180° from alignment with a cartridge delinker to a lower position in line with the bolt assembly and chamber 124. Because of the relative size difference between the first and second pinion gears 150, 152, a 90° rotation of the first pinion gear rotates the second pinion gear 180°.

Bolt Carrier

The feed rotor shaft 154 freely slides longitudinally through a bore formed in a bolt carrier 160, described in detail below. The bolt carrier 160 is seen in greater detail in FIGS. 17-18, and comprises an irregular structure that interacts with a number of different components within the receiver 112. More specifically, FIG. 17A is a perspective view of a bolt carrier 160 assembled with several shafts configured for sliding movement therethrough, while FIG. 17B is a perspective view and FIGS. 18A-18D are orthogonal views of just the bolt carrier.

Figure 18B:
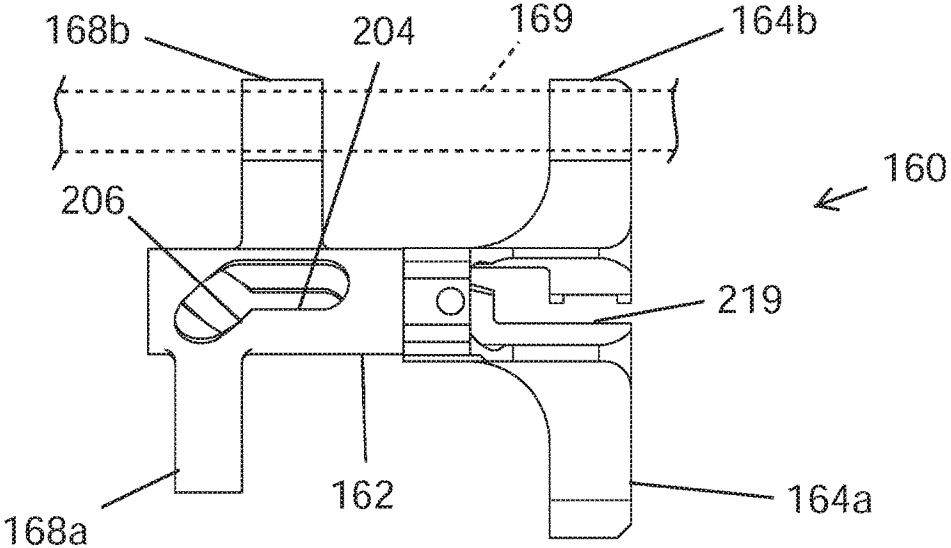
FIGS. 18A-18D are orthogonal views of the bolt carrier.
Figure 18D:
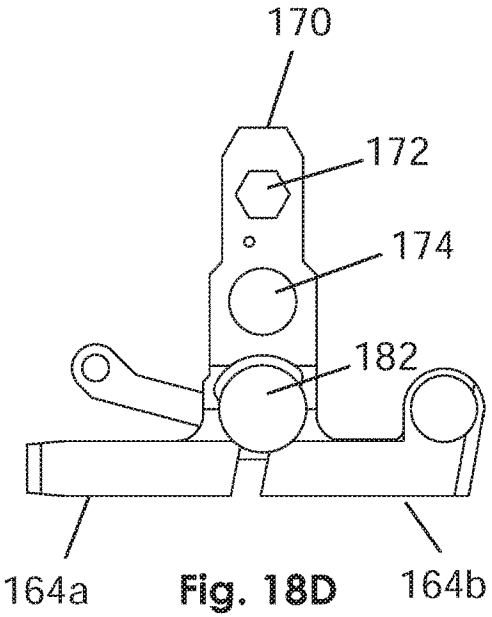

It will be understood that when assembled in the receiver 112, the left side in FIG. 18B is in the forward direction toward the barrel 114, while the right side is to the rear, with the left-right axis being aligned with the longitudinal/horizontal directions. Moreover, the front and rear elevational views of FIGS. 18C and 18D, respectively, define the vertical up and down directions. The bolt carrier 160 as seen from above in FIG. 18B has an offset H-shape with a central longitudinal tube 162 forming the middle bridge in the "H". At the rear end of the tube 162, a pair of lateral arms 164*a*, 164*b* extend outward at a relatively low elevation and define thereby a downwardly-directed channel 166. As will be explained below, the channel 166 receives a bolt drive pin that projects upward and is carried by the chain 144 which moves the bolt carrier 160. Toward the front end of the tube 162, a second pair of lateral arms 168*a*, 168*b* extend outward, albeit at offset longitudinal positions along the tube 162. The lateral arms 164*b*, 168*b* on the right side define aligned throughbores that receive and slide along a guide rod 169, also seen in FIG. 2G. The guide rod 169 ensures linear movement of the bolt carrier 160 within the receiver 112.

Figure 17B:
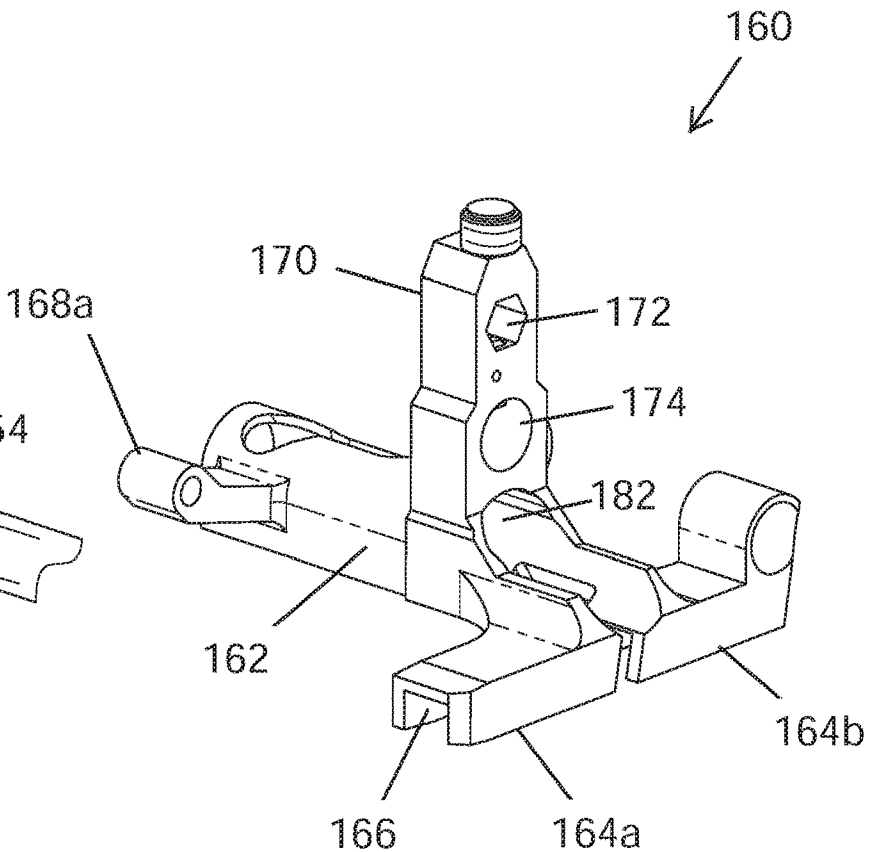
FIG. 17B is a perspective view of just the bolt carrier.
Figure 17A:
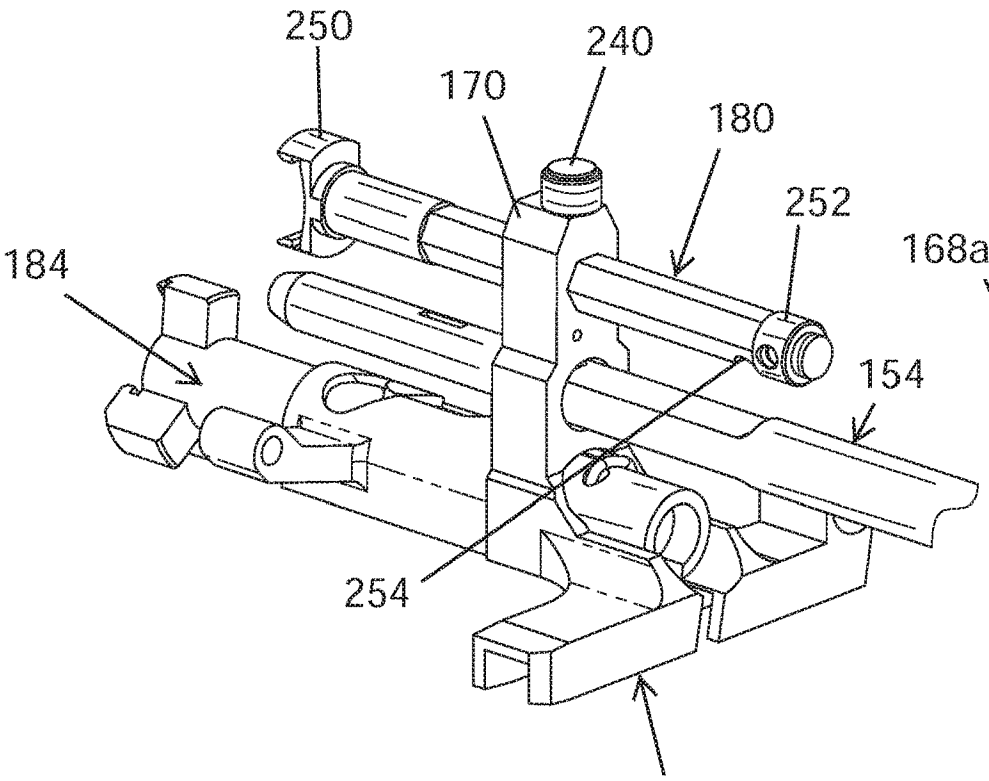
FIG. 17A is a perspective view of a bolt carrier assembled with several shafts configured for sliding movement therethrough.
Figure 18A:
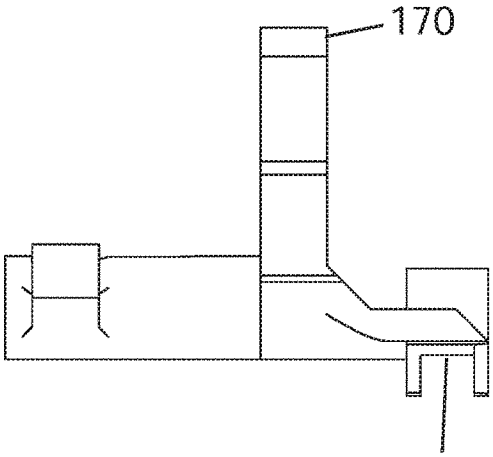
Figure 18C:
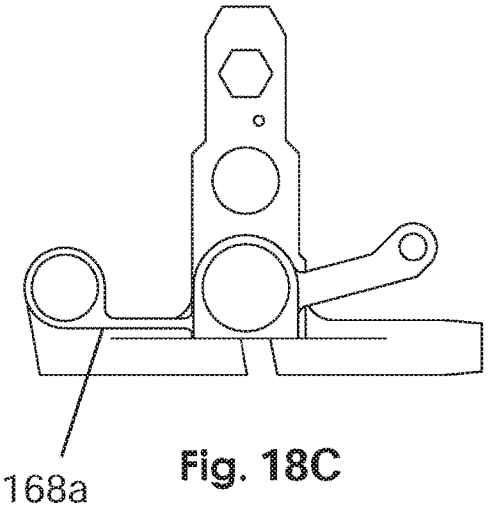

As seen in FIGS. 17B and 18A, a bolt carrier tower 170 is a column that extends upward from an approximate midpoint of the longitudinal tube 162. The bolt carrier tower 170 serves to coordinate and align the movements of several key components of the receiver 112. As seen in FIGS. 17A and 17B, the bolt carrier tower 170 has two longitudinally-oriented throughbores 172, 174. An upper hexagonal delinker throughbore 172 receives for sliding movement therein a delinker shaft 180, which also has a hexagonal cross-section to prevent relative rotation in the throughbore 172. (Although hexagonal mating shapes are considered preferable, other mating shapes to prevent rotation are contemplated, such as a simple flat on one side of both positive and negative elements, a key and keyway, octagonal, etc. Suffice it to say, the delinker shaft 180 slides freely through but is prevented from rotation by the throughbore 172 in the bolt carrier 160.) A lower cylindrical throughbore 174 receives for sliding movement and rotation therein the aforementioned feed rotor shaft 154.

Bolt Assembly

With reference again to FIGS. 17B and 18D, the bolt carrier 160 further includes a lower guide bore 182 defined within the central longitudinal tube 162. The guide bore 182 is sized to closely receive for longitudinal and rotation movement therein a bolt assembly including a bolt 184, as seen in FIG. 17A and in more detail in FIGS. 19A/19B and 20A/20B.

The bolt 184 is a generally tubular structure having a three-pronged cartridge grasper 186 on a forward end and housing therein a firing pin 188 and firing spring 190. The bolt 184 has a forward passage 192 sized to receive a cylindrical main body portion of the firing pin 188 and leading to a narrow firing pin bore 194 which receives a forward nose 196 of the firing pin 188. The bolt 184 has a rear passage 198 with a larger diameter than the forward passage 192 and separated therefrom by a lateral channel 200. As seen in FIG. 19B and elsewhere, the firing spring 190 is sized to be closely received in the rear passage 198 and a rearward section of the firing pin 188 extends through the inner bore of the spring.

As seen best in FIG. 19B, a cam pin 202 extends laterally through the lateral channel 200. The cam pin 202 features a lateral through bore 203 which receives the firing pin 188. The cam pin 202 projects radially on both ends beyond the exterior of the bolt 184 and is received within a pair of similarly-shaped cam slots 204 formed in the longitudinal tube 162 of the bolt carrier 160, seen from above in FIG. 18B. The cam slots 204 each have a longitudinally-oriented portion leading to a forward angled portion 206. Because the cam slots 204 cause rotational movement of the cam pin 202 and thus the bolt 184, the angled portions 206 are offset in the same rotational orientation around the longitudinal tube 162.

With reference again to the cutaway view of FIG. 19B, the firing pin 188 is shown within the longitudinal passages 192, 198 of the bolt 184 such that the forward nose 196 is positioned within but not beyond the firing pin bore 194. A small space 208 is thus formed within the forward passage 192 to accommodate forward movement of the firing pin 188. Although not shown, a cartridge 118 held within the three-pronged cartridge grasper 186 is positioned such that the forward nose 196 of the firing pin 188 can strike the rear center of and thus fire the cartridge. The force needed to fire the cartridge 118 is provided by the firing spring 190.

Figure 15A:
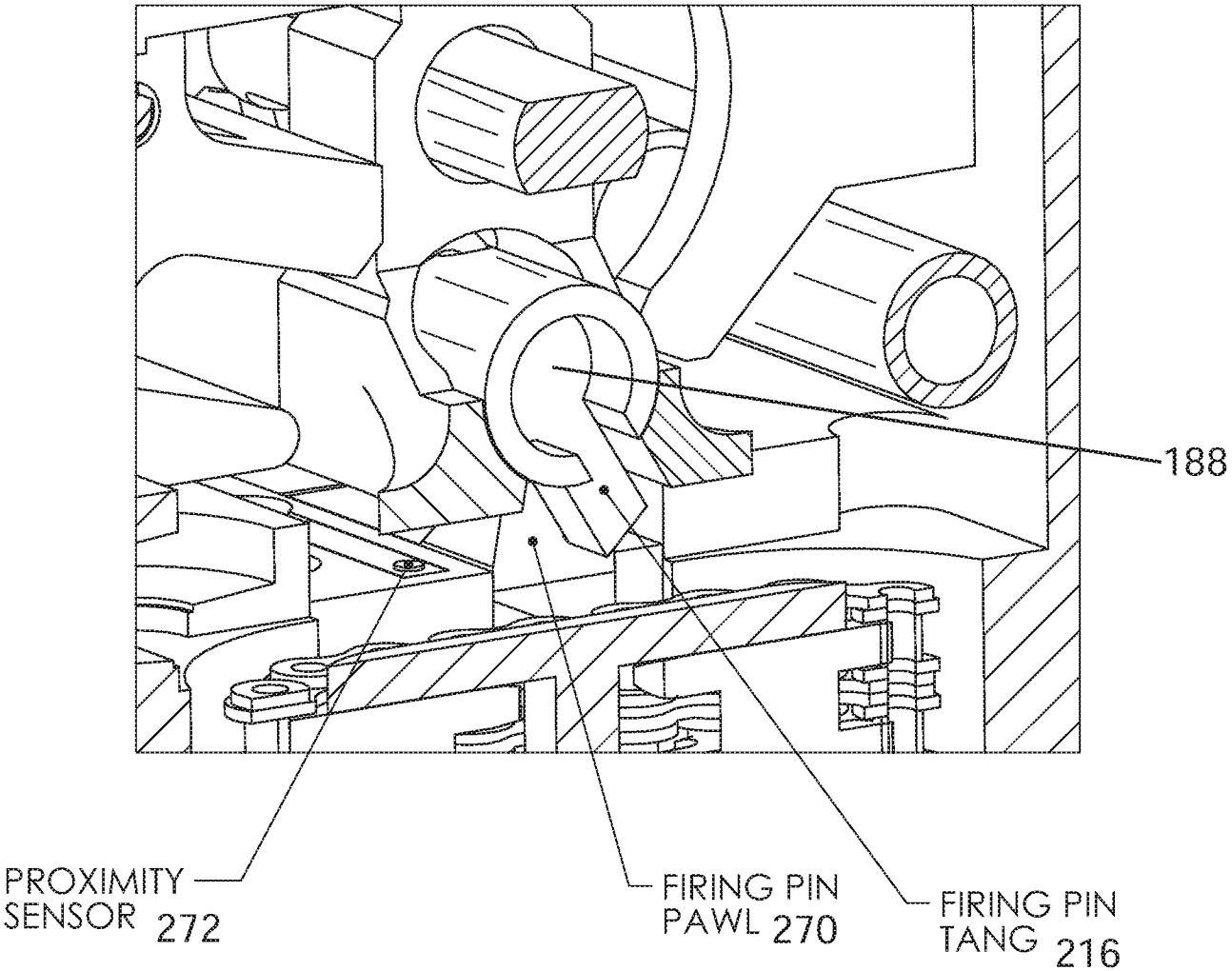
FIGS. 15A-15D are enlarged views of a rear end of a firing pin and firing pin tang which rotates to ensure that there is no delayed functioning, or hangfire, of a fired round of ammunition.
Figure 15B:
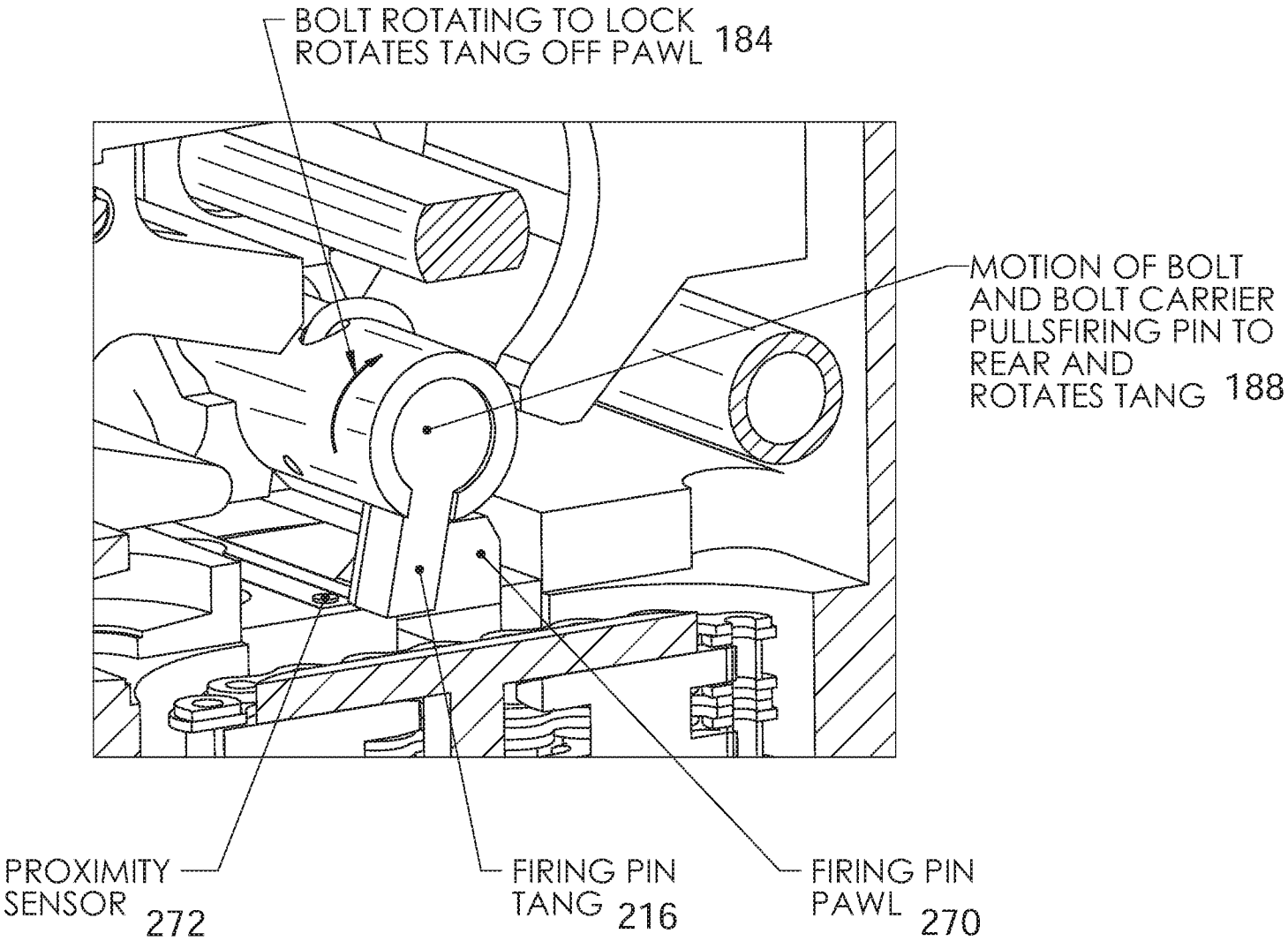
Figure 15C:
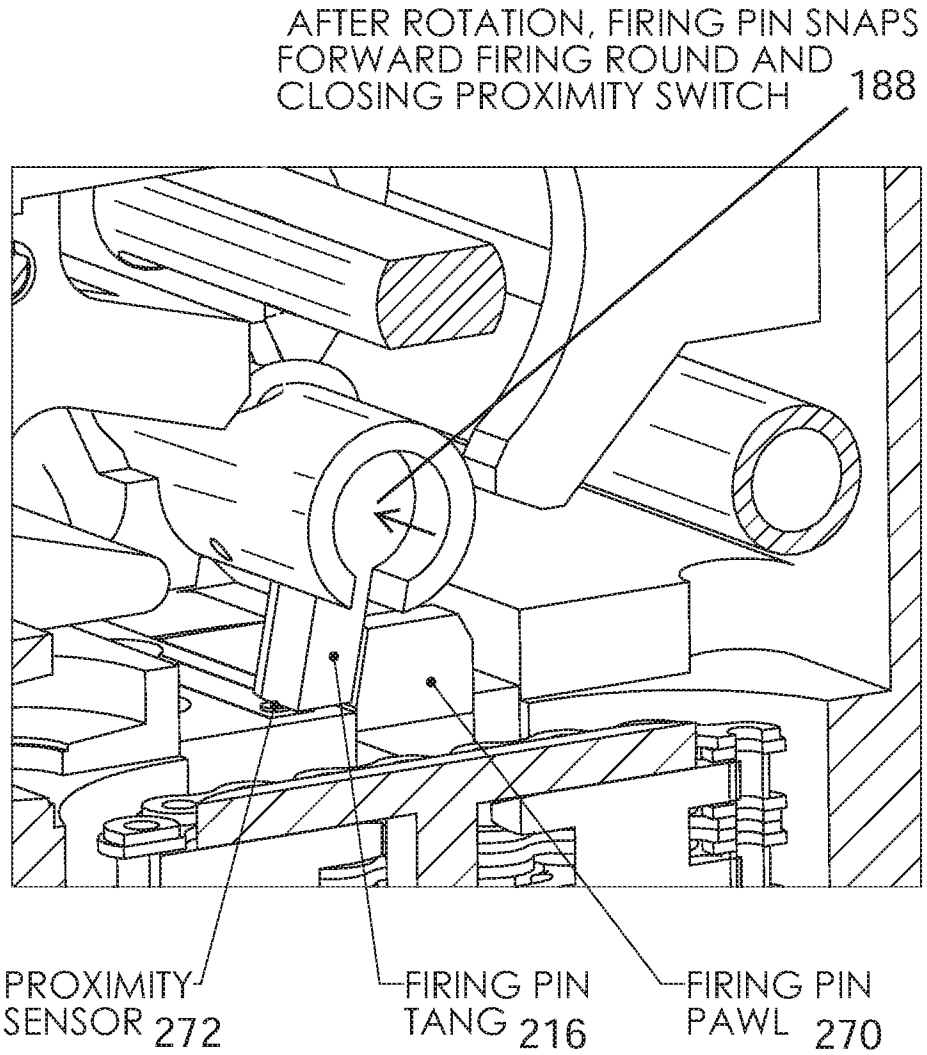
Figure 15D:
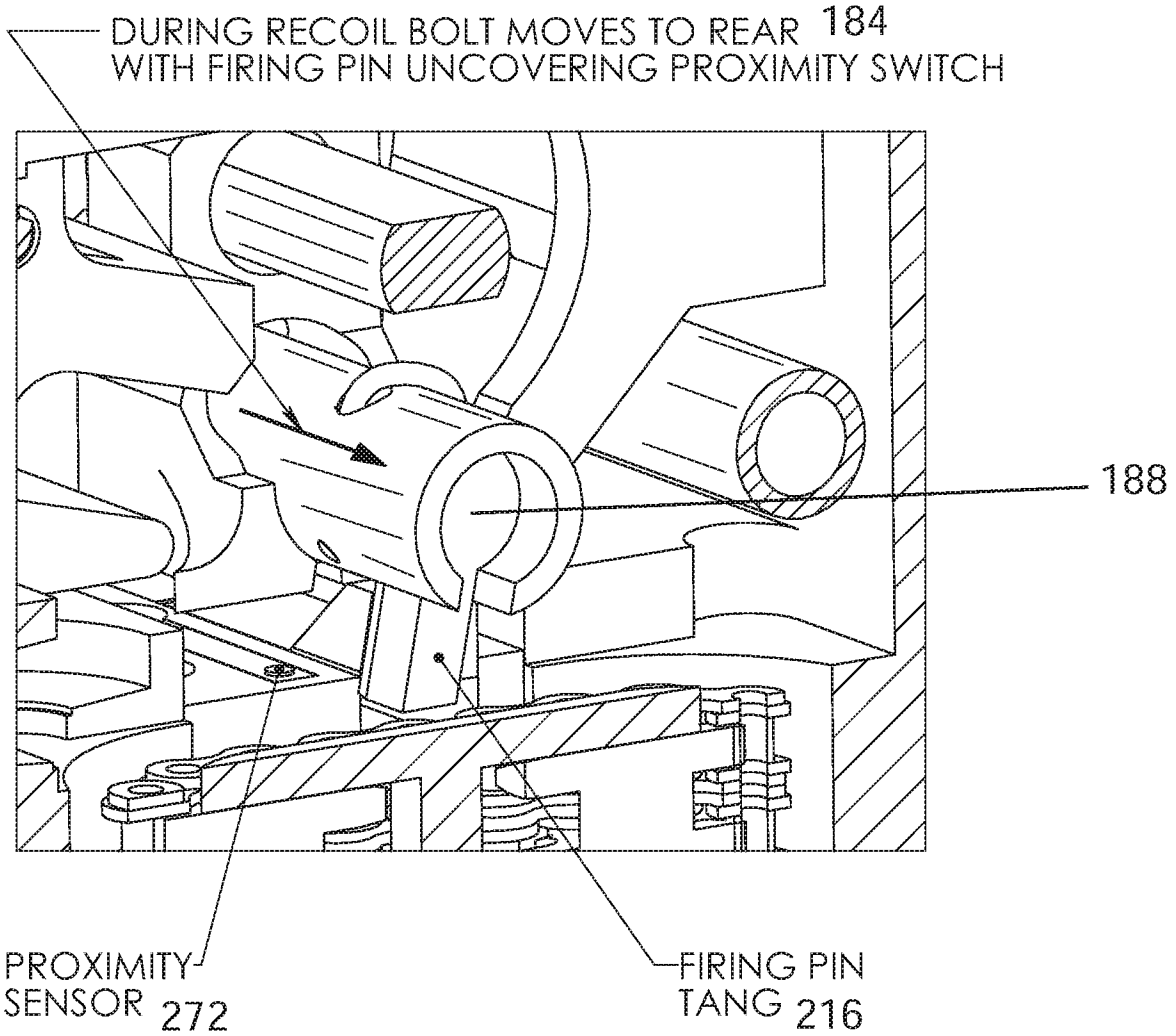

It is important to note that the firing spring 190 is constrained between a forward collar 210 fixed around a groove and circlip 212 on the firing pin 188 and a horseshoe clip 214 that extends into the rear passage 198 from outside of the bolt 184 and longitudinal tube 162 of the bolt carrier 160. The forward collar 210 initially abuts the cam pin 202. The rear of the spring 190 is constrained from rearward movement by the horseshoe clip 214 and mating collar 215, with the clip 214 also engaging a pair of vertical slots 217 in opposite sides of the bolt 184 (see FIG. 20A). In this regard, the horseshoe clip 214, and thus the rear of the spring 190, is held with respect to the bolt 184. As the carrier 160 moves forward, the firing pin 188 is restrained by a fixed pawl 270 within the receiver 112 (FIG. 15A). This movement pulls the collars 210, 215 rearward relative to the horseshoe clip 214, which continues to move forward with the carrier 160, thus compressing the firing spring 190.

Operation

Figure 2E:
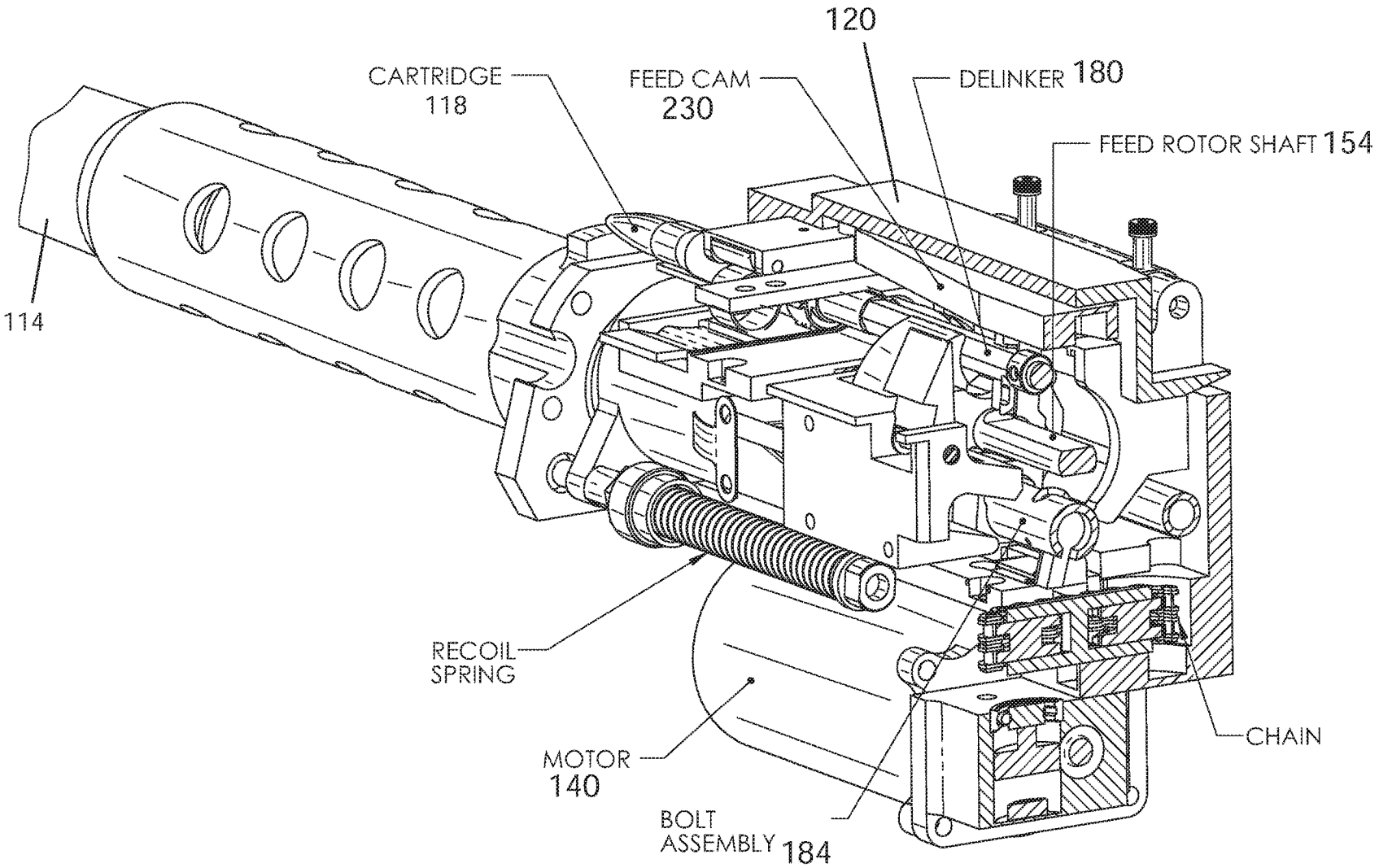
FIGS. 2E-2G are cutaway perspective and lateral sectional views of the delinking and firing mechanism of the compact 50 caliber chain-driven machine gun of the present application.
Figure 2F:
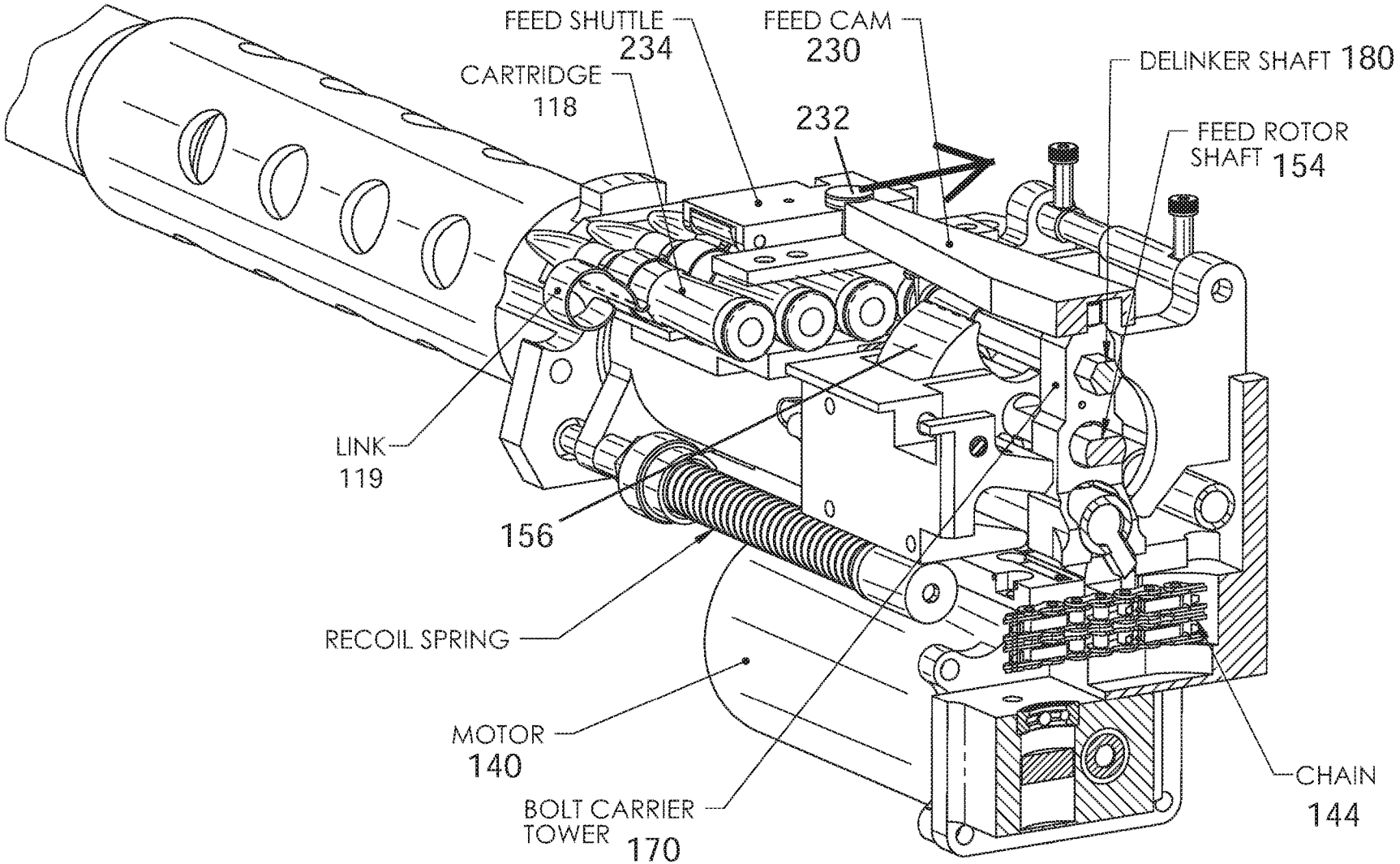
Figure 2G:
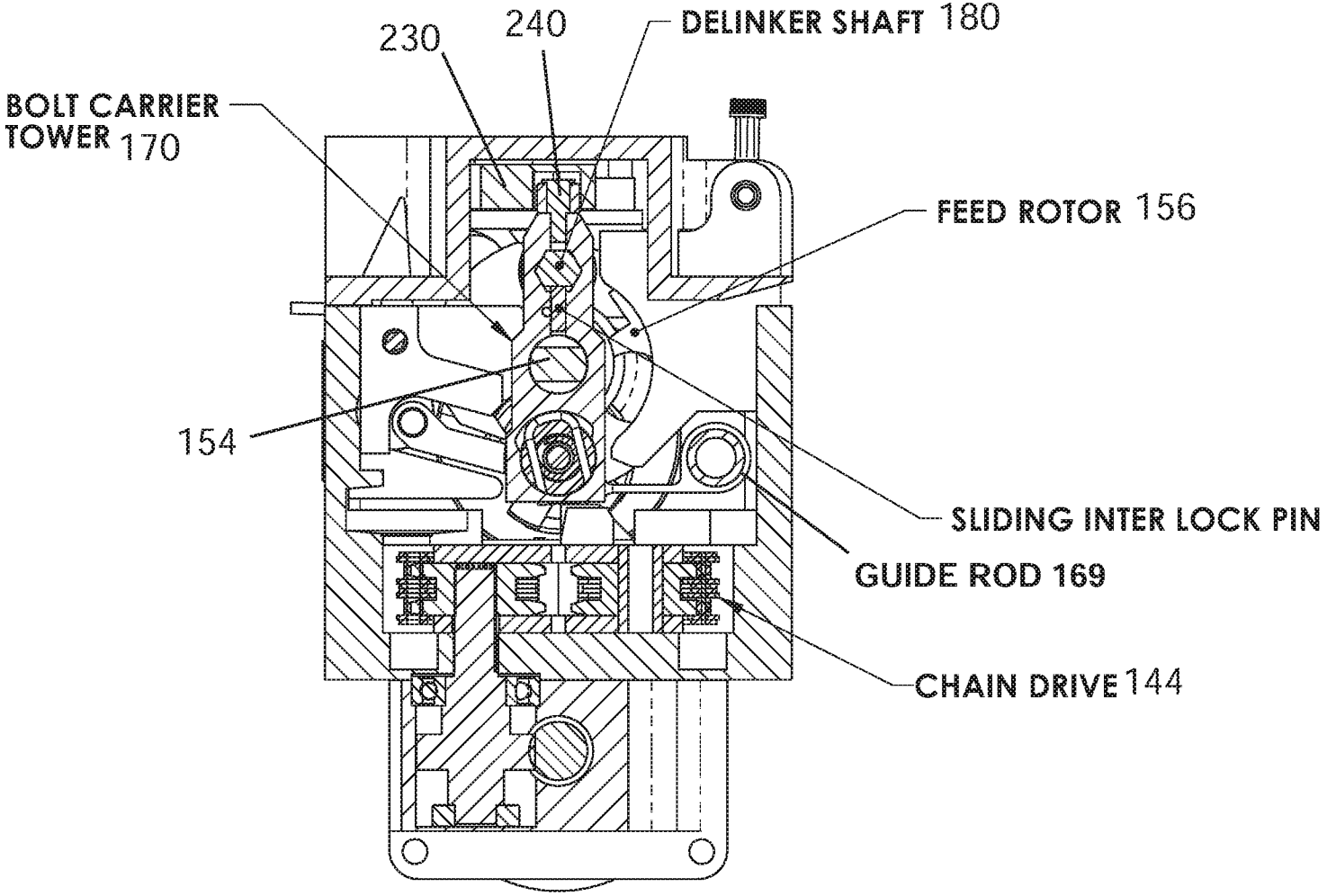

FIGS. 2E-2G are cutaway perspective and lateral sectional views of the delinking and firing mechanism of the compact 50 caliber chain-driven machine gun of the present application. As shown, the bolt carrier 160 is positioned within the mechanism such that the vertical bolt carrier tower 170 generally aligns the upper hexagonal throughbore 172 (see FIG. 17B) and the delinker shaft 180 carried thereby with the lateral slot above the receiver 112 through which the cartridges 118 in their flexible belt of links 119 are guided. The delinker shaft 180 thus serves to decouple or delink each of the cartridges 118 from the belt of links 119. Similarly, the lower cylindrical through bore 174 (FIG. 17B) and the feed rotor shaft 154 that passes therethrough are vertically aligned with the feed rotor 156 which serves to transfer each cartridge 118 down from the delinking area to the area of the firing chamber. Finally, the bolt 184 is at a low elevation that aligns with the chamber 124 (FIG. 3A) for receiving the cartridges 118, and ultimately with the gun barrel 114.

FIGS. 2E and 2F show an assembly within the feed cover 120 for advancing the cartridges 118 in step-wise fashion from left-to-right as shown to be available for the delinker shaft 180. Namely, a feed cam 230 resembling an elongated arm has a forward end 232 that reciprocates laterally due to a horizontal pivoting of the feed cam, as will be explained. The forward end 232 engages an aperture in a feed shuttle 234 that slides laterally over the belt of links 119 holding the cartridges 118. The feed shuttle 234 has a ratchet-style mechanism (not shown) on its underside which translates the belt of links 119 in one direction only (to the right in FIG. 2F). That is, the feed shuttle 234 engages the links 119 when moving to the right, but slides past the links 119 when returning to the left.

The feed cam 230 pivots about a rear pin 236 fixed in the feed cover 120, as seen in FIG. 2B. The shape of the feed cover 120 generally describes the reciprocal pivoting of the feed cam 230. As seen best in FIGS. 3B and 5B, the feed cam 230 has an inner channel defining contoured inner walls 238 which are in contact with a feed cam drive roller 240 at the top of the bolt carrier 160.

Figure 16A:
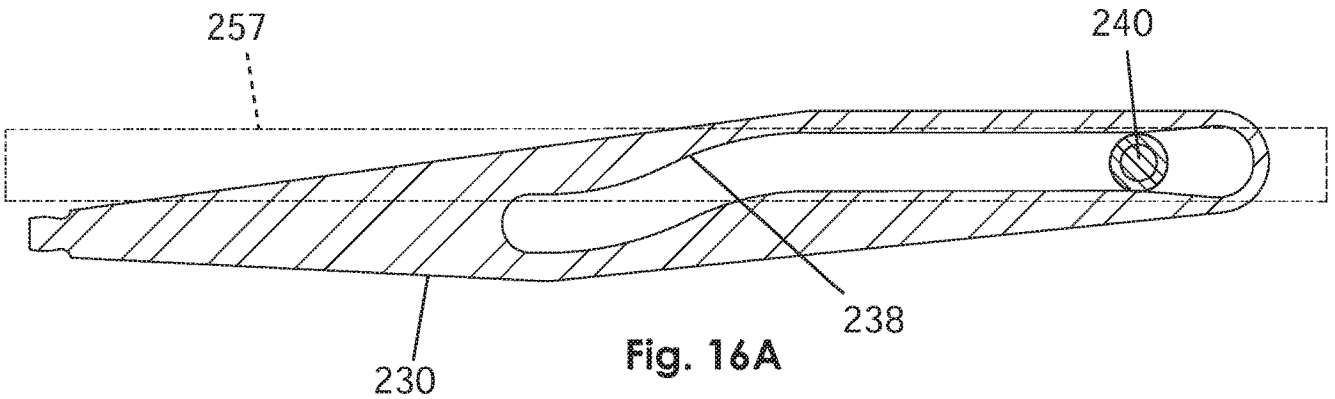
FIGS. 16A-16C are horizontal sectional views of a feed cam showing a contoured inner channel and sequential movement of a feed cam roller therein.
Figure 16B:
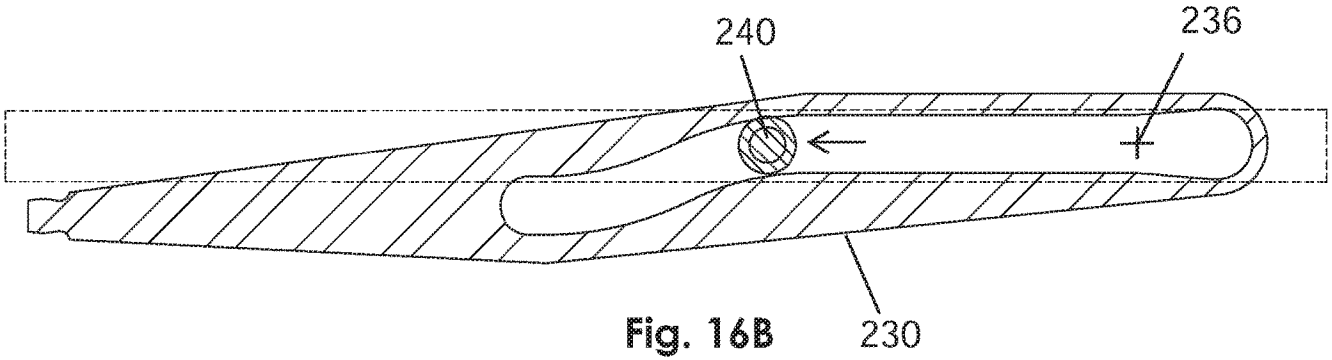
Figure 16C:
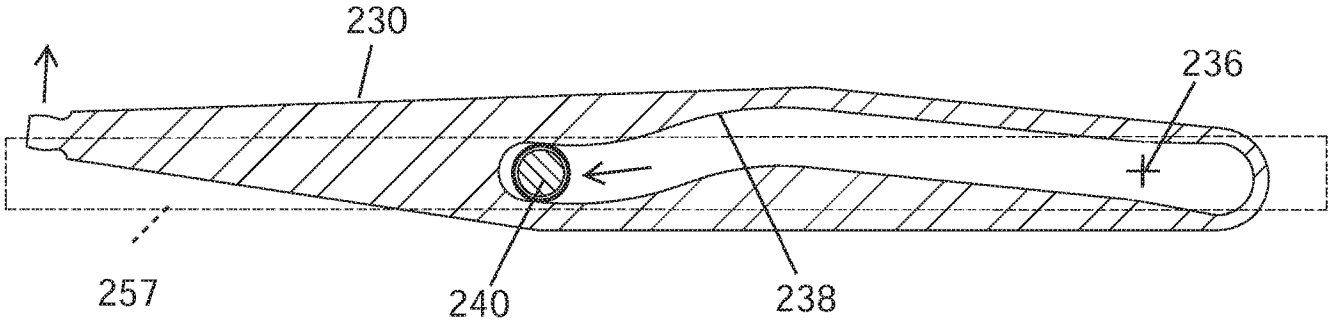

The shape of the inner channel of the feed cam 230 is seen in FIGS. 16A-16C which are horizontal sectional views of the feed cam showing sequential movement of the feed cam drive roller 240 therein. In particular, longitudinal movement of the bolt carrier 160 causes the feed cam drive roller 240 to engage the contoured inner walls 238 and thus pivot the feed cam 230. As a result, reciprocal axial movement of the bolt carrier 160 and its roller 240 causes the feed cam 230 to rock back and forth which in turn drives the feed shuttle 234 to displace one cartridge 118 at a time into alignment with the front end of the delinker shaft 180.

Now with reference to FIG. 2G, a lateral vertical section at the rear end shows various key components, including the delinker shaft 180 and feed rotor shaft 154, which extend longitudinally in parallel and pass through the aforementioned bores 172, 174 in the tower 170 (FIG. 17B) of the bolt carrier 160.

FIG. 3A is a longitudinal sectional view of the delinking and firing mechanism of the present application in an operation step of a sear position prior to delinking a 50 caliber round or cartridge 118, and FIG. 3B is a cutaway perspective view of the same step. A cartridge 118 is seen at the upper left in FIG. 3A held within the belt of links 119. In FIG. 3A, the cartridge 118 is the first to be fired from the gun, and no cartridge can be seen within the chamber 124, though in the middle of a sequence of firing, FIG. 3A would show a just-fired cartridge within the chamber. The cartridge 118 can be seen in step-by-step sequence in FIGS. 3-14 as it transitions from the belt to a firing position.

All the various operating steps are driven by the chain 144, which is tensioned around four sprockets arranged in a rectangular pattern. An upwardly-projecting bolt drive pin 242 (FIG. 3A) fixed with respect to the chain 144 is mounted on a master link 244 and engages the bolt carrier 160. As the upward pin 242 travels forward along one of the long sides of the rectangular chain travel, it drives the bolt carrier 160 forward. Conversely, when the upward pin 242 travels rearward along the other long side of rectangular chain travel, it brings the bolt carrier 160 rearward. When the pin 242 travels laterally across the receiver 112 and along the channel 166 defined by the lateral arms 164*a*, 164*b* of the bolt carrier 160, the carrier dwells or pauses its longitudinal movements. During one of these dwells, a lower Geneva drive pin 246 (FIG. 3A) projecting down from the master link 244 enters one of four slots in the Geneva drive 146 located at a rear end of the receiver and rotates the drive 90°. As explained elsewhere, rotation of the Geneva drive 146 ultimately causes rotation of the feed rotor 156 which transfers the cartridges 118 from the delinking location to the firing location.

In the first step of FIGS. 3A and 3B, the bolt carrier 160 is in a rearward position. As seen in FIGS. 17B and 18A, the channel 166 defined by the lateral arms 164*a*, 164*b* of the bolt carrier 160 receives the upwardly-projecting bolt drive pin 242 (FIG. 3A). At this stage, the drive pin 242, and the master link 244 from which it projects, is located at the rear of the chain drive 144, at the outer extent of the left-side lateral arm 164*a* (FIG. 3B). The chain 144 rotates in a CCW direction, and thus advancement of the chain carries the drive pin 242 laterally along the channel 166, with the result that the bolt carrier 160 dwells or remains stationary.

At the same time, a lower Geneva drive pin 246 (FIG. 3A) projecting down from the master link 244 enters one of four radial slots (not numbered) in the Geneva Drive 146. CW movement of the chain 144 carries the drive pin 246 into the slot and rotates the Geneva Drive 146 in a CCW direction. This also rotates the first and second pinion gears 152 which in turn rotates the feed rotor shaft 154 and feed rotor 156, though at this stage there is no cartridge 118 shown in position to be transferred to the firing chamber area.

Figure 4A:
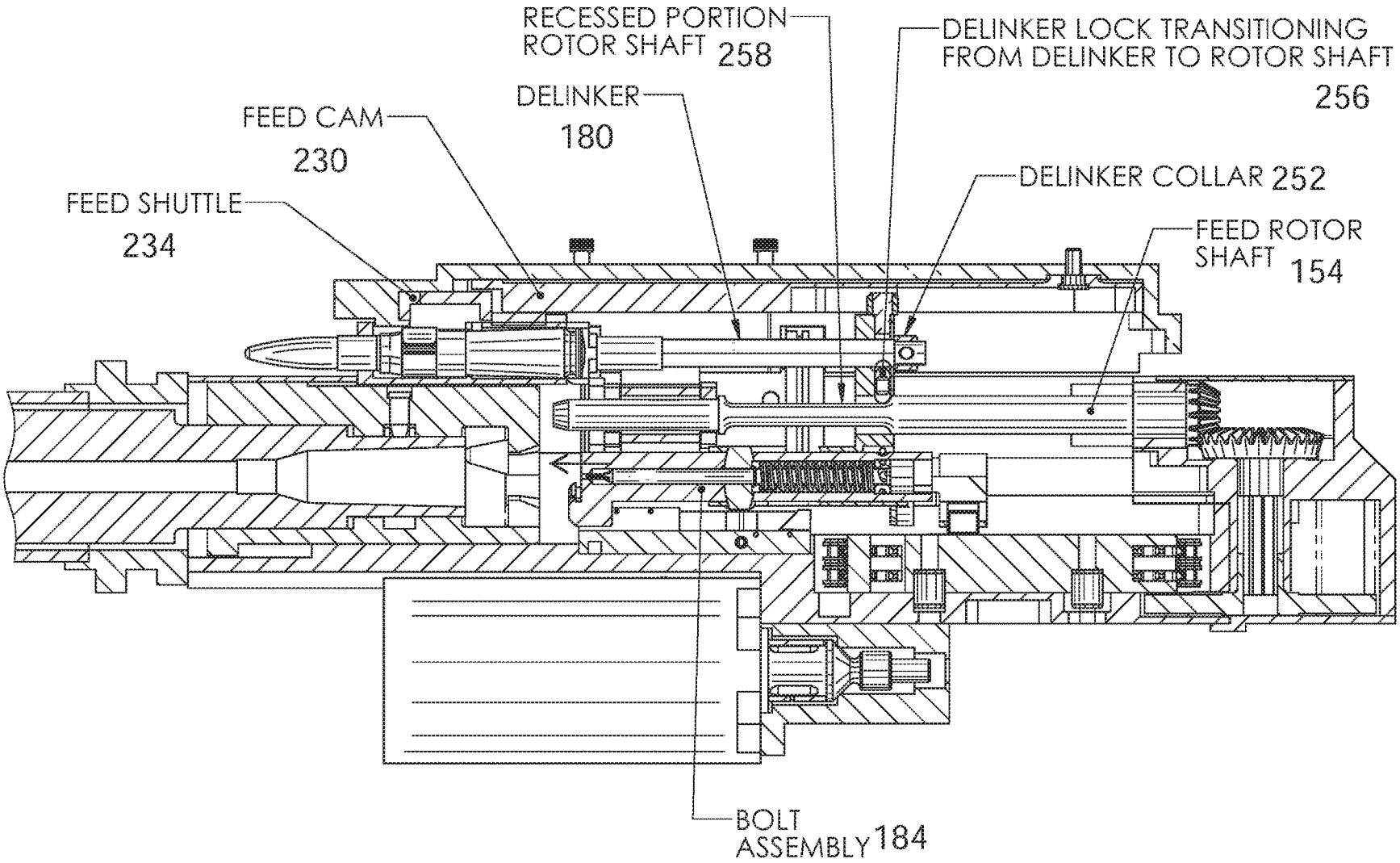
FIG. 4A is a longitudinal sectional view and FIG. 4B is a cutaway perspective view of the delinking and firing mechanism after forward movement of a bolt assembly which moves a delinker forward into position ready to engage a cartridge.
Figure 4B:
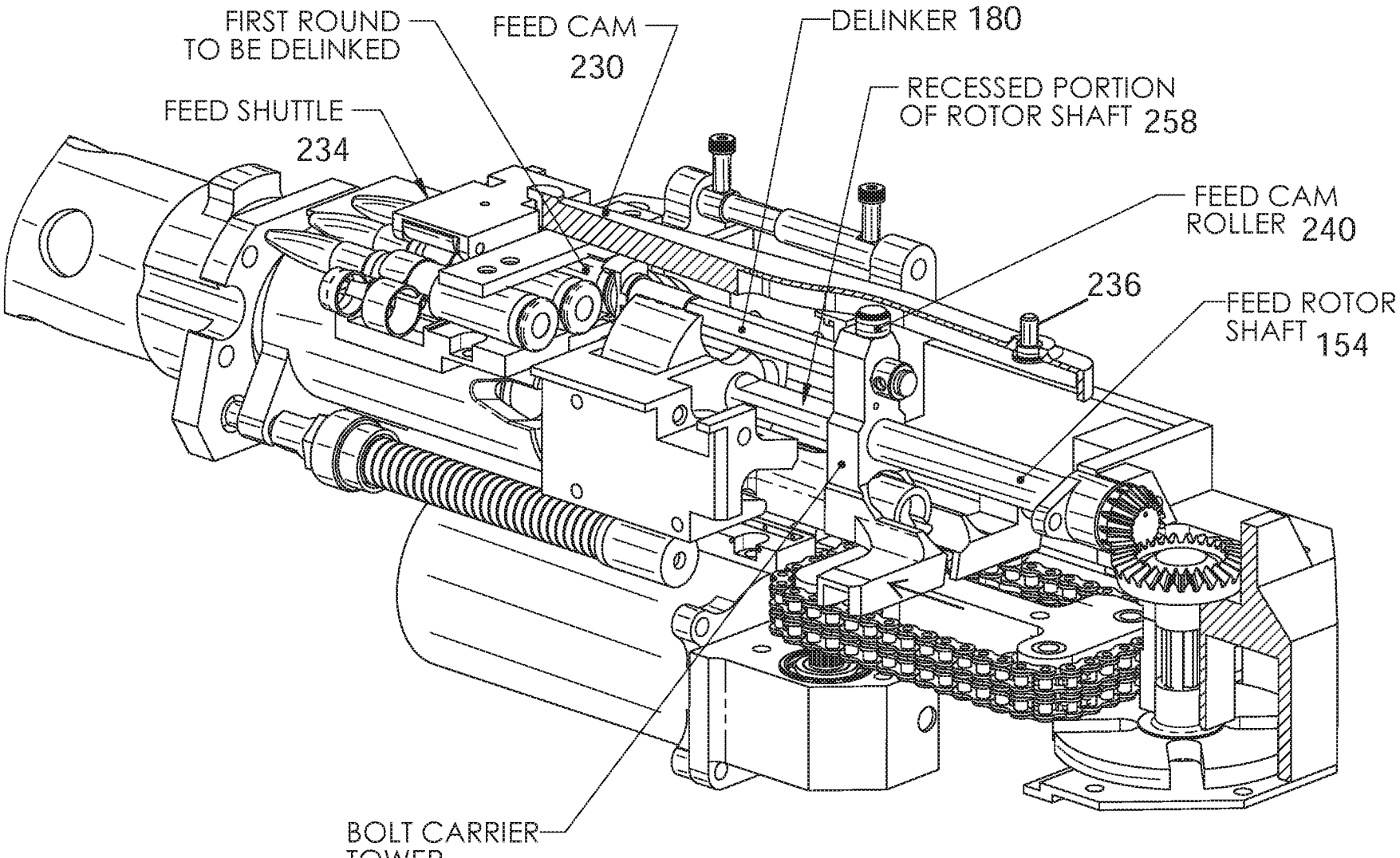

FIGS. 4A and 4B show the delinking and firing mechanism after initial forward movement of the bolt assembly including the bolt 184. As was described above, the bolt 184 is coupled to the longitudinal tube 162 of the bolt carrier 160 via the cam pin 202 in the cam slots 204.

Prior to the stage seen in FIGS. 4A and 4B, the bolt carrier 160 is acted on by the chain drive 144 to move in a forward direction. That is, the bolt drive pin 242 eventually reaches the extent of its lateral rightward travel along the rear section of the chain drive 144 and turns a 90° corner (again CW) to commence forward motion. The drive pin 242 remains within the channel 166 defined by the lateral arms 164*a*, 164*b* of the bolt carrier 160 and thus acts on the inner walls of the channel to urge the bolt carrier 160 forward. Although not shown, the bolt carrier 160 is positioned within a cavity in the receiver 112 which permits sliding longitudinal movement therethrough between two positions, and is lubricated and guided to prevent binding.

Figure 6A:
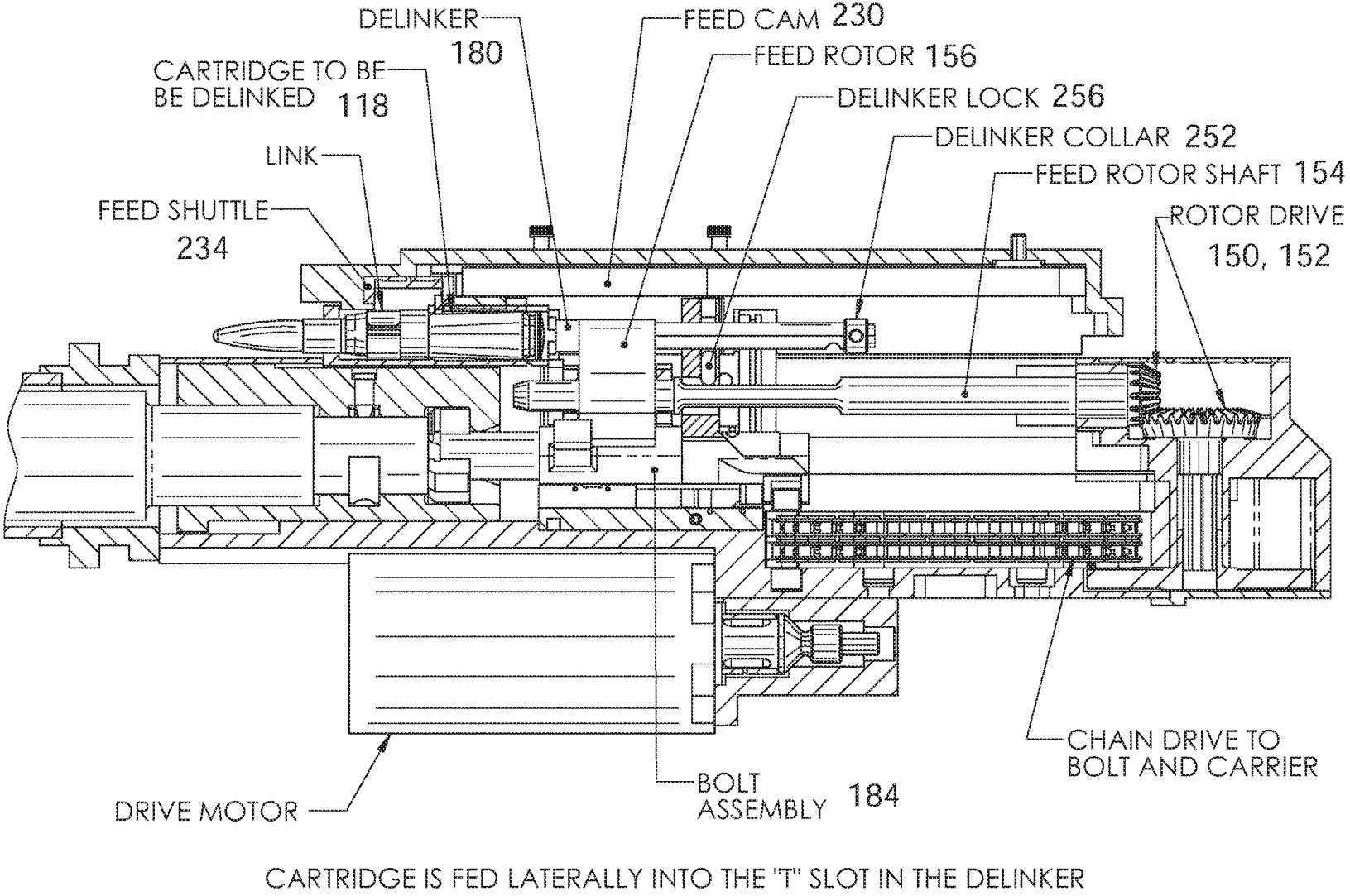
FIG. 6A is a longitudinal sectional view and FIG. 6B is a cutaway perspective view of the mechanism during an operation step of laterally feeding a cartridge from the ammunition belt of linked cartridges into engagement with a delinker.

Forward movement of the bolt carrier 160 moves the delinker shaft 180 forward into position to engage a cartridge 118. The movement of the delinker shaft 180 during delinking, transferring and firing the cartridges requires an understanding of the interaction between movement of it and the bolt carrier 160. With reference first to FIG. 17A, the delinker shaft 180 has a forward end that terminates in a delinker grabber 250 comprising two bifurcated fingers with in-turned tabs forming a T-slot that receives the flange at the rear end of each cartridge 118. FIG. 6A shows the delinker grabber 250 engaged with the first cartridge 118 in this manner.

The delinker shaft 180 further includes a collar 252 fixed to a rear end thereof via a pin or similar expedient, which enables the tower 170 to displace the delinker shaft 180 to the rear. Just forward from the collar 252, the delinker shaft 180 has a small indent 254 on an underside thereof which receives an inter-locking pin 256 in an elevated position. When the inter-locking pin 256 is elevated, longitudinal movement of the tower 170 is coupled to that of the delinker shaft 180. The inter-locking pin 256 is positioned in a vertical space formed in the tower 170 of the bolt carrier 160 which permits the pin to drop down when the pin reaches a flat or recessed section 258 formed on the feed rotor shaft 154, as best seen in FIG. 4A. There are two opposed recessed sections 258 to accommodate 180° rotation of the feed rotor shaft 154. That is, as the bolt carrier tower 170 moves the delinker shaft 180 forward over the stationary feed rotor shaft 154, eventually the tower reaches one of the recessed sections 258 and the pin 256 drops down. This movement disengages further forward movement of the tower 170 from the delinker shaft 180, which is the position shown in FIGS. 4A and 4B. It is this decoupling of the delinker shaft 180 from movement of the bolt carrier 160 and bolt 184 which enables the receiver 112 of the gun to be made much shorter in axial length.

In addition, the moment that the pin 256 drops down into the recessed section 258 is the start of the pivoting of the feed cam 230 and thus movement of the feed shuttle 234. That is, the feed cam drive roller 240 carried at the top of the tower 170 contacts a curved section of the contoured inner wall 238 of the feed cam 230 at the same time movement of the tower 170 disengages from movement of the delinker shaft 180. The delinker shaft 180 thus remains stationary while the feed cam 230 and feed shuttle 234 deliver the next cartridge 118.

FIGS. 16A-16C showing sequential forward movement of the feed cam drive roller 240 within the inner channel 238 of the feed cam 230. Since the drive roller 240 is carried longitudinally by the bolt carrier 160, it travels in a linear path indicated by a dashed rectangle 257. The drive roller 240 engages the contoured inner walls 238 and thus pivots the feed cam 230 about its rear pivot pin 236 fixed in the feed cover 120, as shown.

The length of the delinker shaft 180 and extent of forward movement prior to disengagement from the tower 170 positions the delinker grabber 250 in line to capture the rear end of the next cartridge when it is displaced laterally by the feed shuttle 234. Again, the lateral movement of the feed shuttle 234 is enabled by the camming action of the feed cam drive roller 240 against the contoured inner wall 238 of the feed cam 230.

FIG. 5A is a longitudinal sectional view and FIG. 5B is a cutaway perspective view of the delinking and firing mechanism after further forward movement of the bolt carrier 160 and bolt 184 to the forward extent of their travels. With reference to FIG. 5B, the action of the chain 144 is seen. Although not shown, the master link 244 and upward drive pin 242 turn the front left corner and continue traveling laterally along the channel 166 formed on the underside of the bolt carrier 160. Movement of the bolt carrier 160 is halted or dwells in this stage.

Figure 6B:
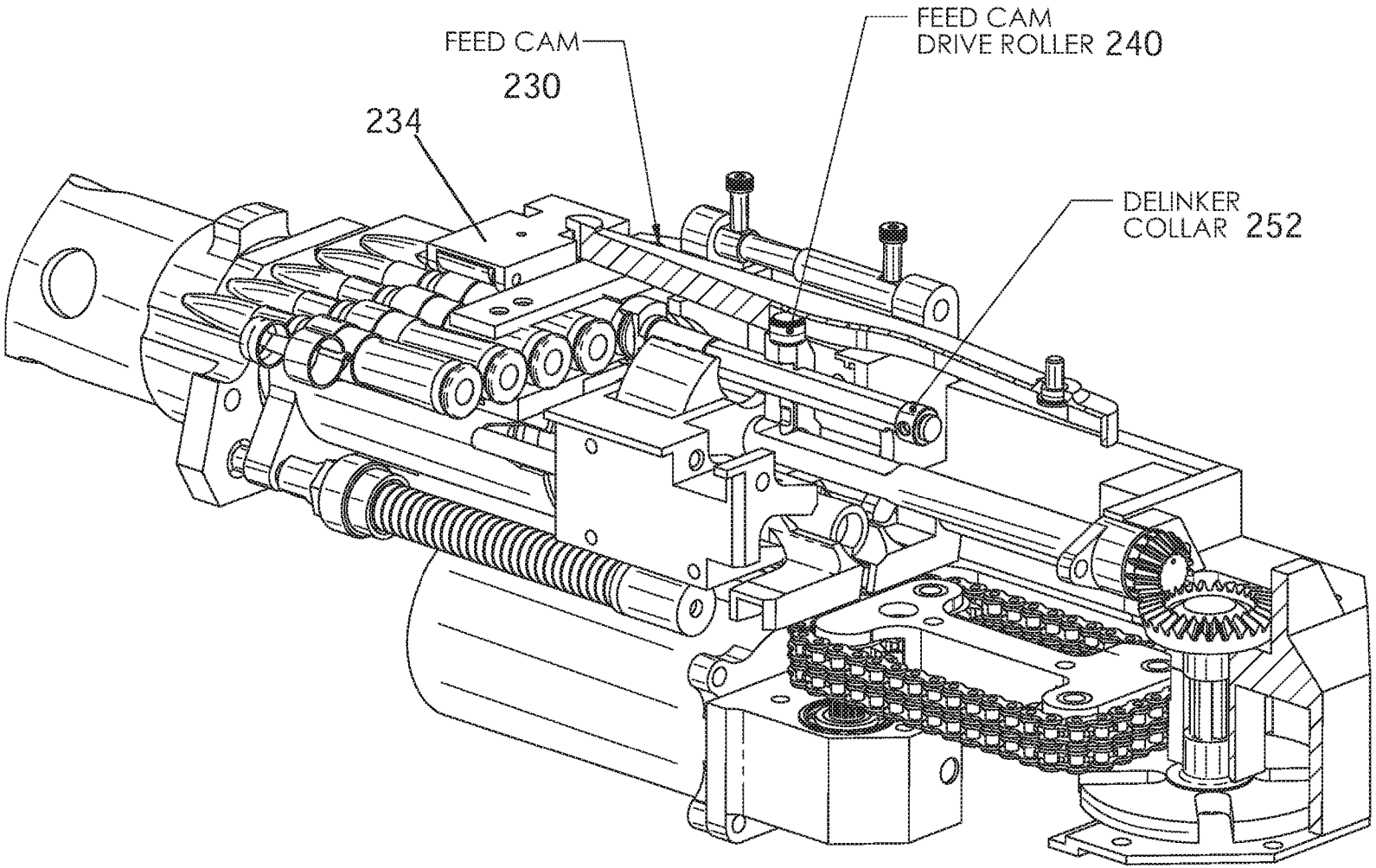

FIG. 6A is a longitudinal sectional view and FIG. 6B is a cutaway perspective view of the mechanism during an operation step of laterally feeding a cartridge 118 from the ammunition belt of linked cartridges into engagement with the T-slot on the delinker grabber 250. Initial rearward travel of the bolt carrier 160 causes the camming action of the feed cam drive roller 240 against the contoured inner wall 238 of the feed cam 230, which pivots the feed cam to its original position.

Figure 7A:
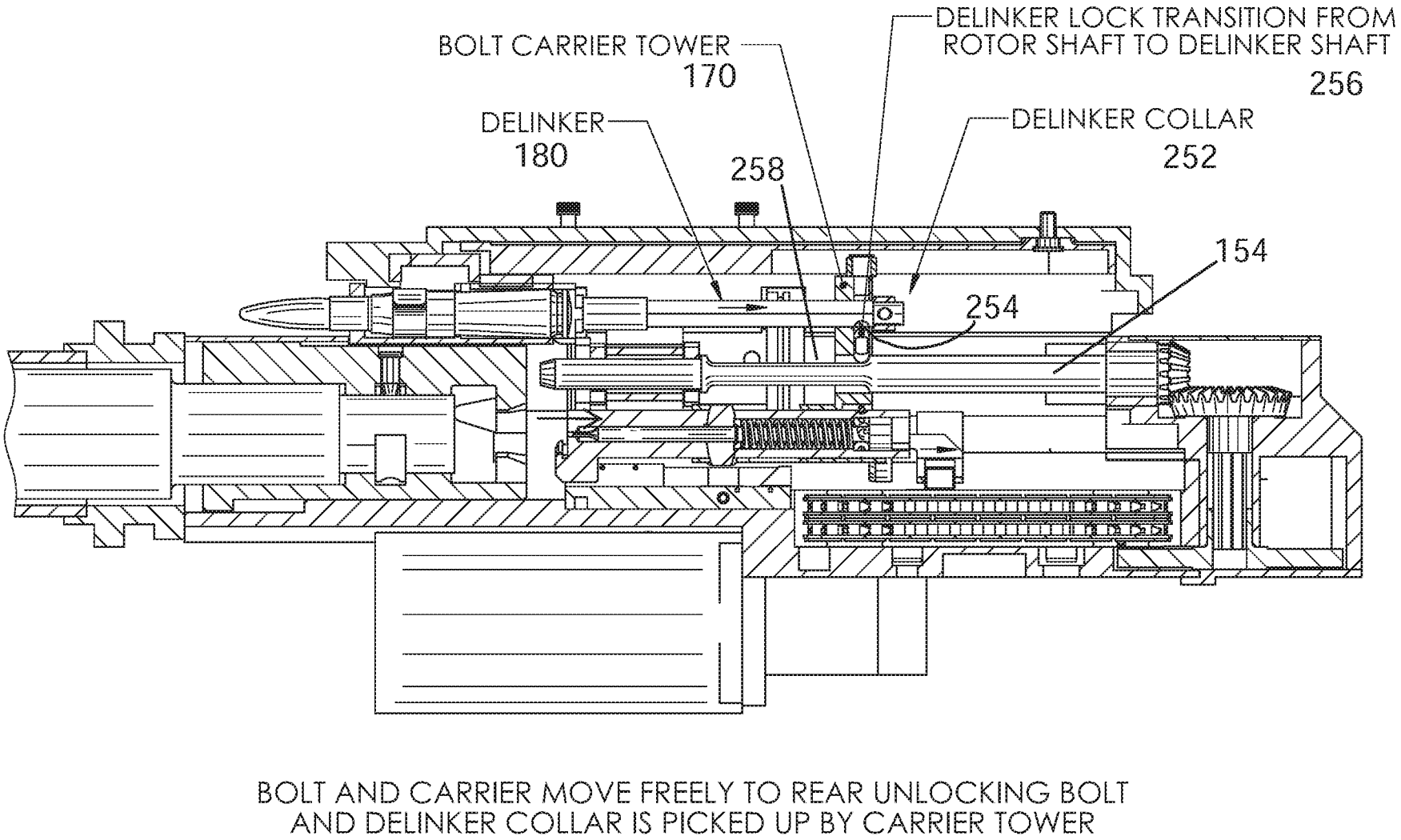
FIG. 7A is a longitudinal sectional view and FIG. 7B is a cutaway perspective view of the delinking and firing mechanism during further rearward movement of the bolt assembly at the point of engaging the delinker for rearward movement so as to delink a cartridge from a cartridge belt, and also when the feed cam returns the feed shuttle to its starting point.
Figure 7B:
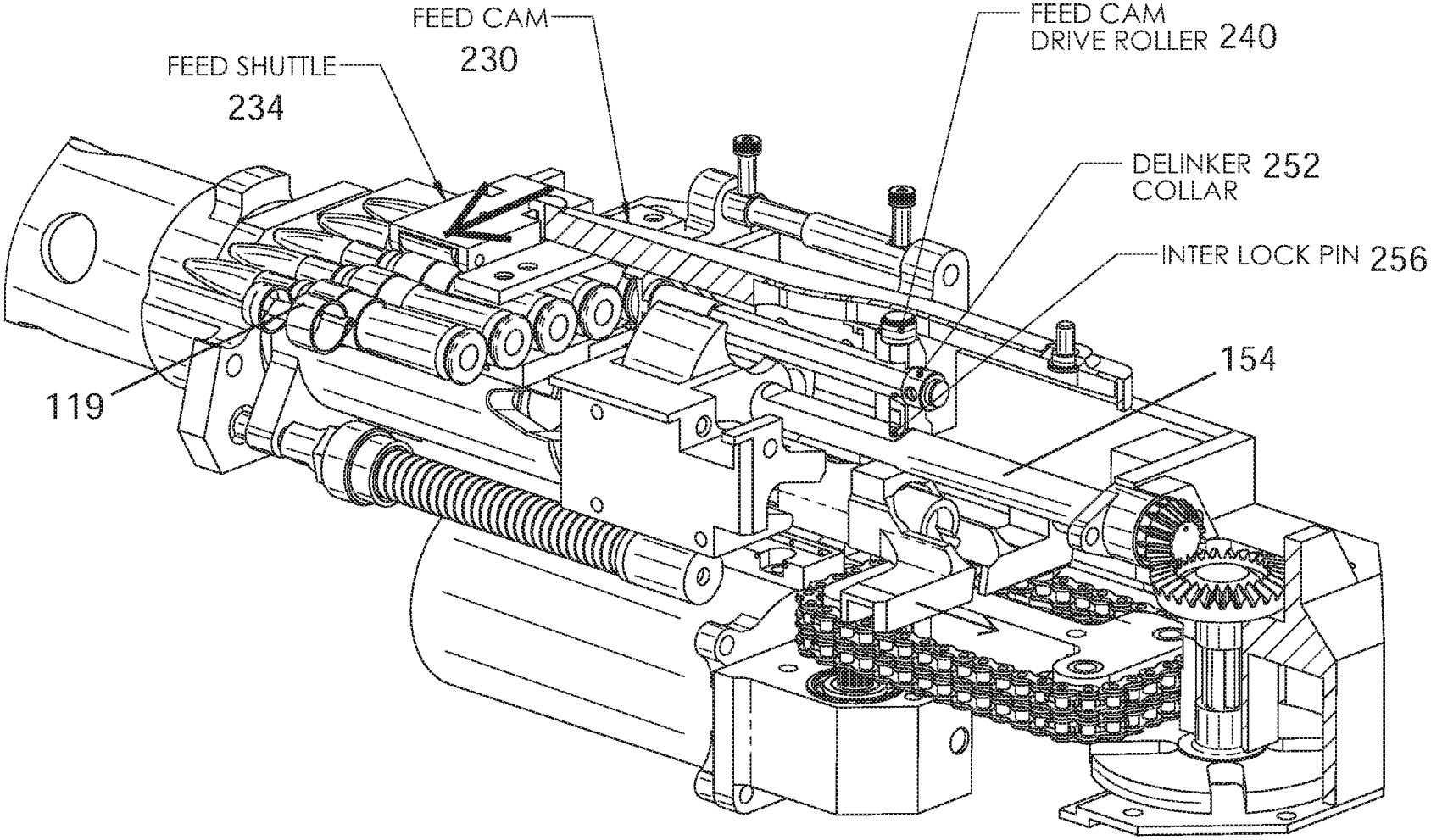

FIG. 7A is a longitudinal sectional view and FIG. 7B is a cutaway perspective view of the delinking and firing mechanism during subsequent rearward movement of the bolt carrier 160 and bolt 184. As the bolt carrier 160 moves rearward, at mid-travel the inter-locking pin 256 carried by the bolt carrier 160 reaches the end of the recessed section 258 on the feed rotor shaft 154. A smoothly curved shoulder at the rear end of the recessed section 258 cams the inter-locking pin 256 back upward into the small indent 254 on the underside of the delinker shaft 180, which has remained stationary during the back-and-forth movement of the bolt carrier tower 170. At about the same time, the rear wall of the tower 170 engages the delinker collar 252 on the rear end of the delinker shaft. This re-engages the delinker shaft 180 with the tower 170 such that further rearward motion carries the delinker shaft 180 rearward. Rearward movement of the delinker shaft 180 removes a cartridge 118 to the rear from the belt of links 119.

Figure 8A:
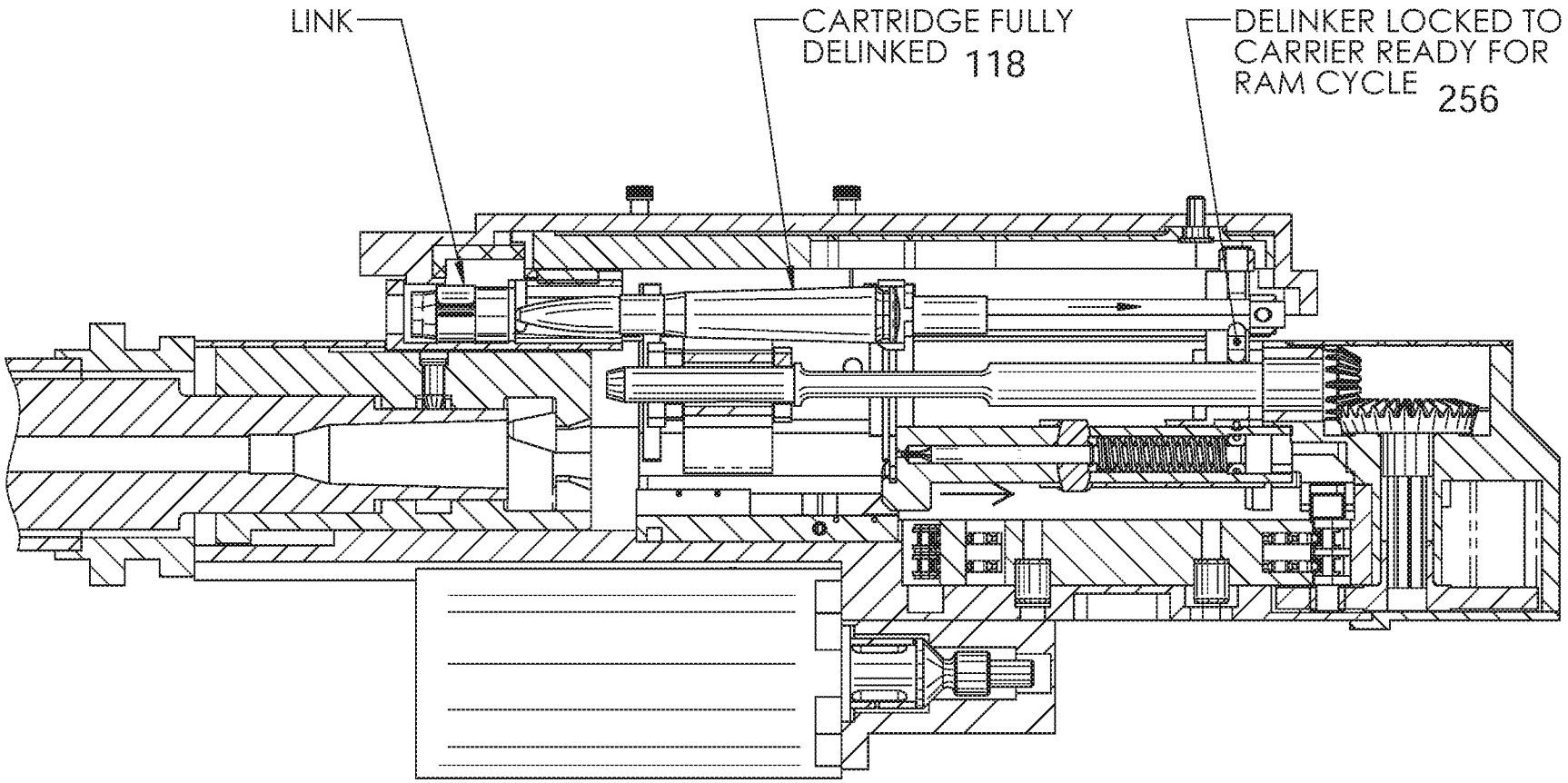
FIG. 8A is a longitudinal sectional view and FIG. 8B is a cutaway perspective view of the delinking and firing mechanism showing further rearward movement of the bolt assembly and delinker fully delinking the cartridge.
Figure 8B:
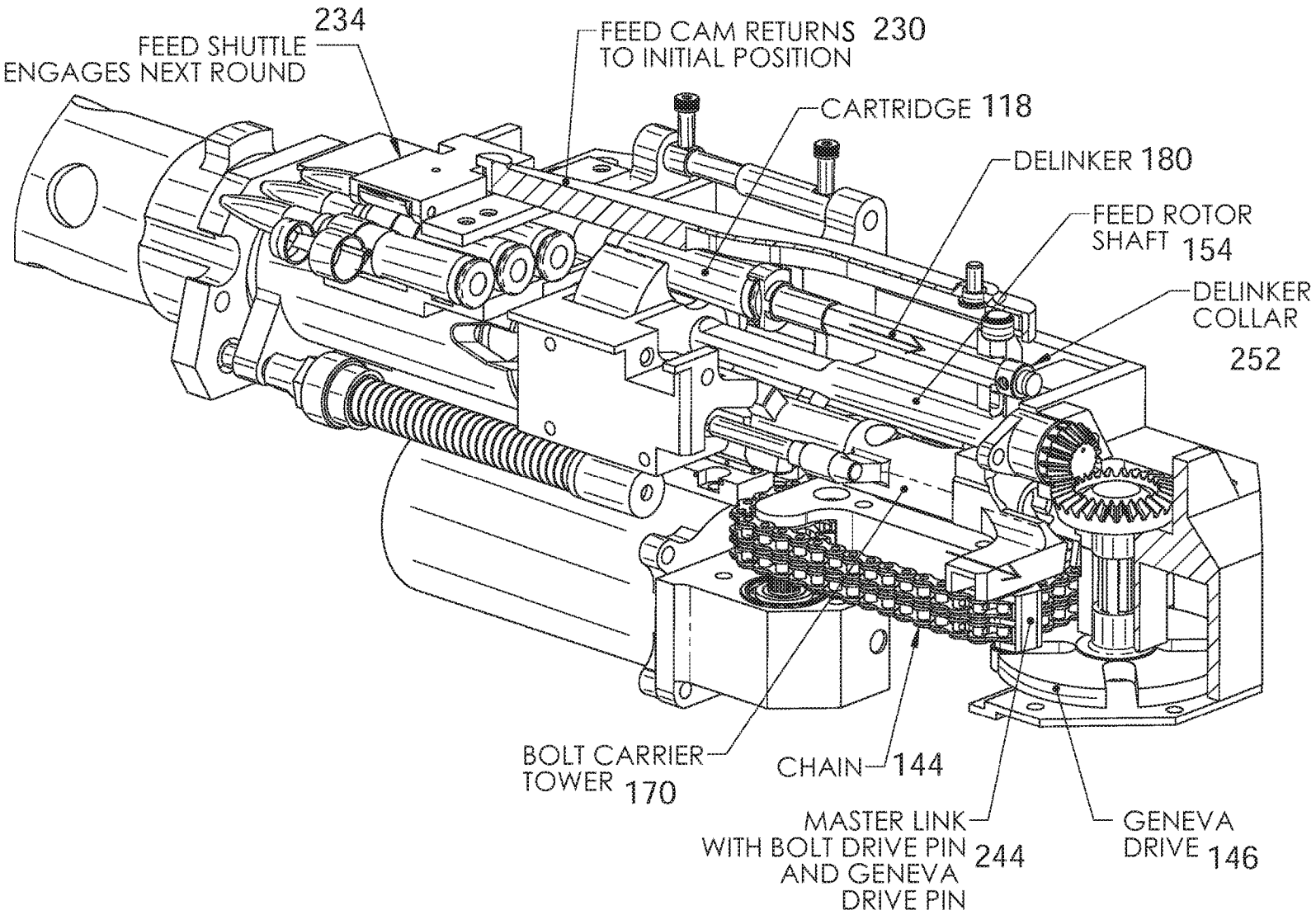

FIG. 8A is a longitudinal sectional view and FIG. 8B is a cutaway perspective view of the delinking and firing mechanism showing further rearward movement of the bolt carrier 160 and bolt 184 and delinker shaft 180 fully delinking the cartridge 118. This reverts the components to the sear position, as seen in FIG. 3A.

The reader will note that the master link 244 on the chain 144 is once again at the rear left corner on the rectangular chain path. The master link 244 has moved laterally from right-to-left in a CW direction which pauses movement of the bolt carrier 160. However, the lower Geneva drive pin 246 (FIG. 3A) enters one of the slots of the Geneva Drive 146, which rotates the first pinion gear 150 90° and the second pinion gear 152 180°.

Figure 9:
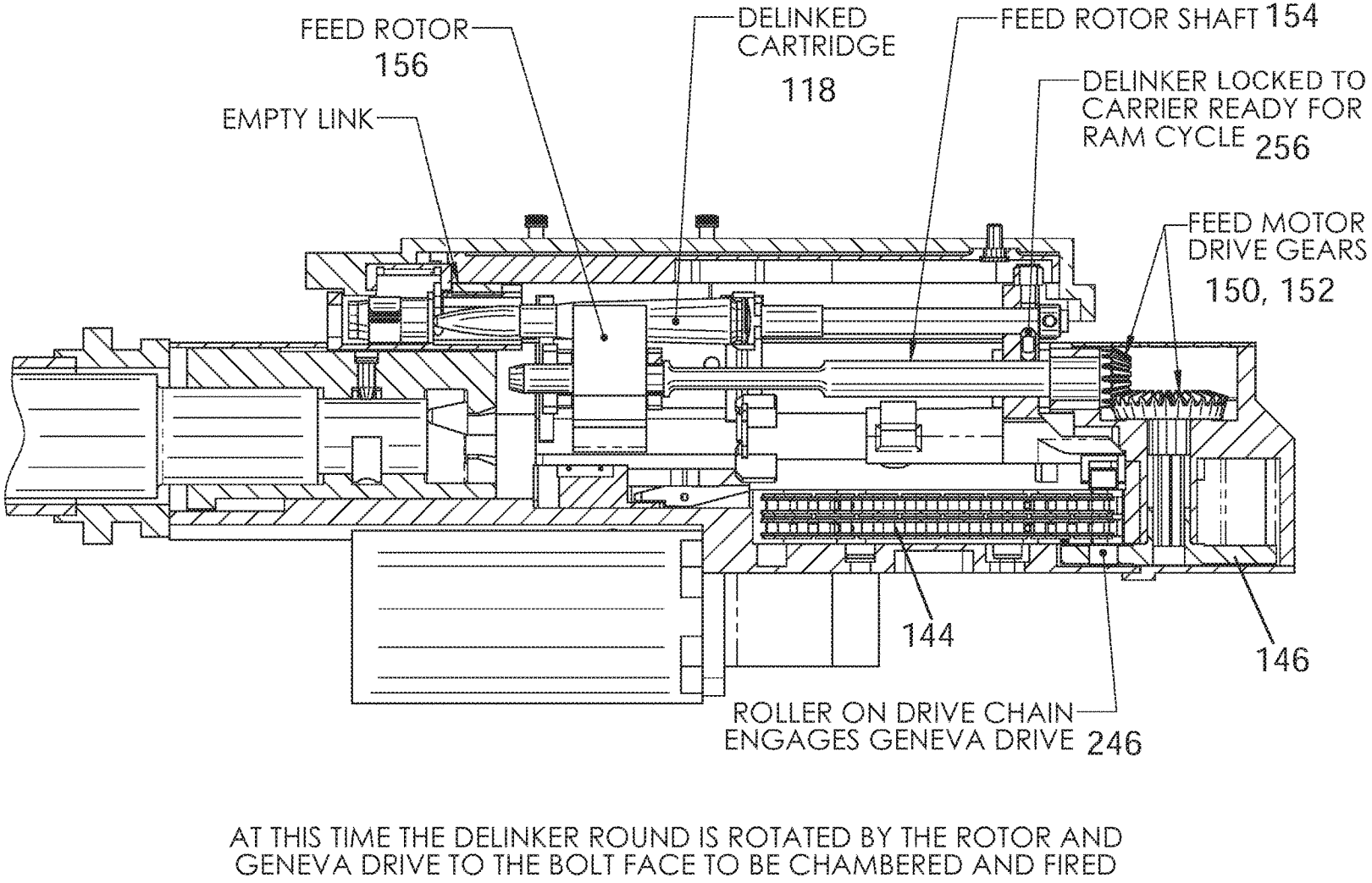
FIG. 9 is a longitudinal sectional view of the delinking and firing mechanism just prior to the feed rotor rotating the cartridge to be chambered and fired.

FIG. 9 is a longitudinal sectional view of the delinking and firing mechanism just prior to rotating the cartridge 118 to be chambered and fired. The feed rotor shaft 154 then rotates the feed rotor 156 which transfers the cartridge 118 from the delinked location downward into alignment with the bolt 184 and chamber 124.

Figure 10A:
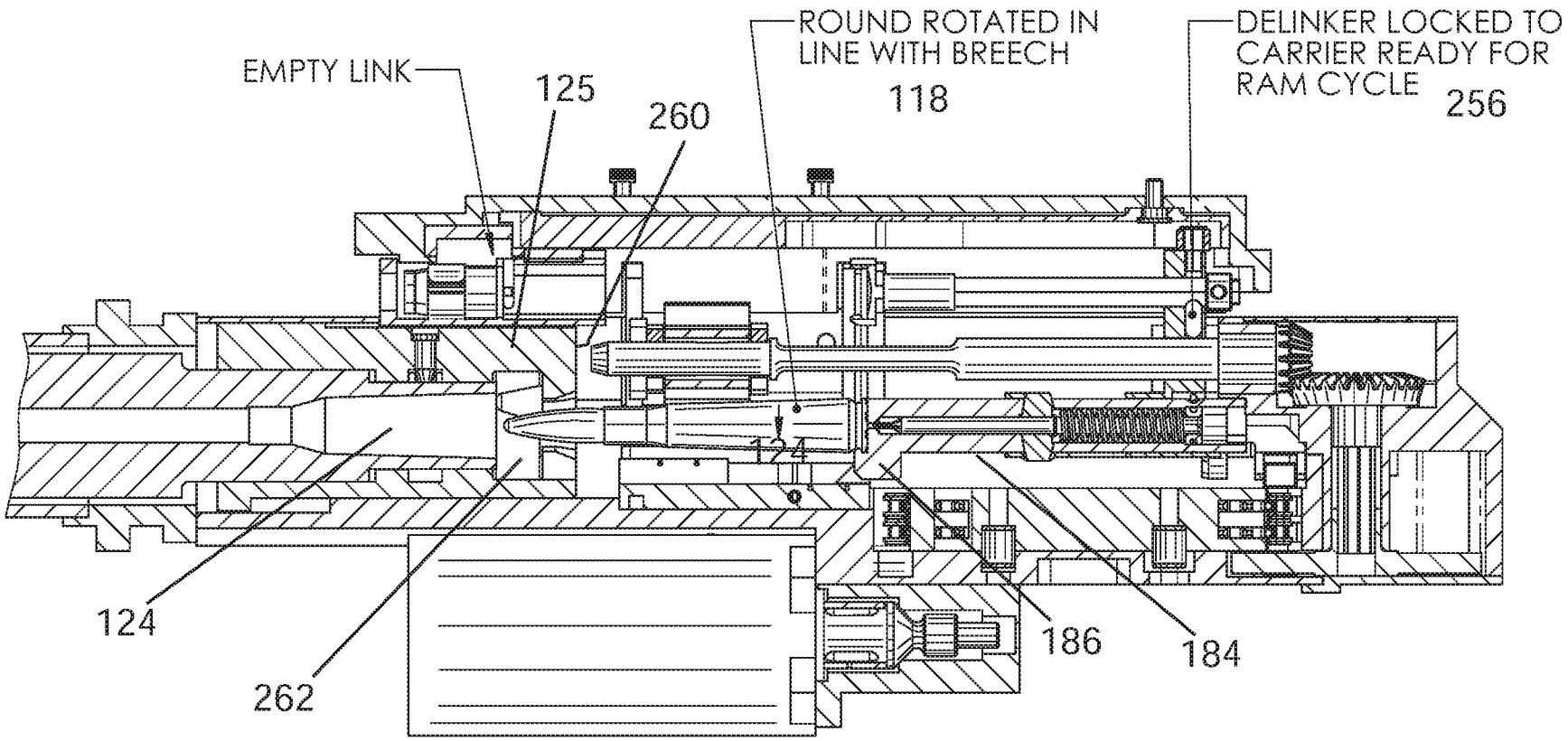
FIG. 10A is a longitudinal sectional view and FIG. 10B is a cutaway perspective view of the delinking and firing mechanism showing rotation of a feed rotor to move the delinked cartridge in line with the bolt assembly and into position to be chambered.
Figure 10B:
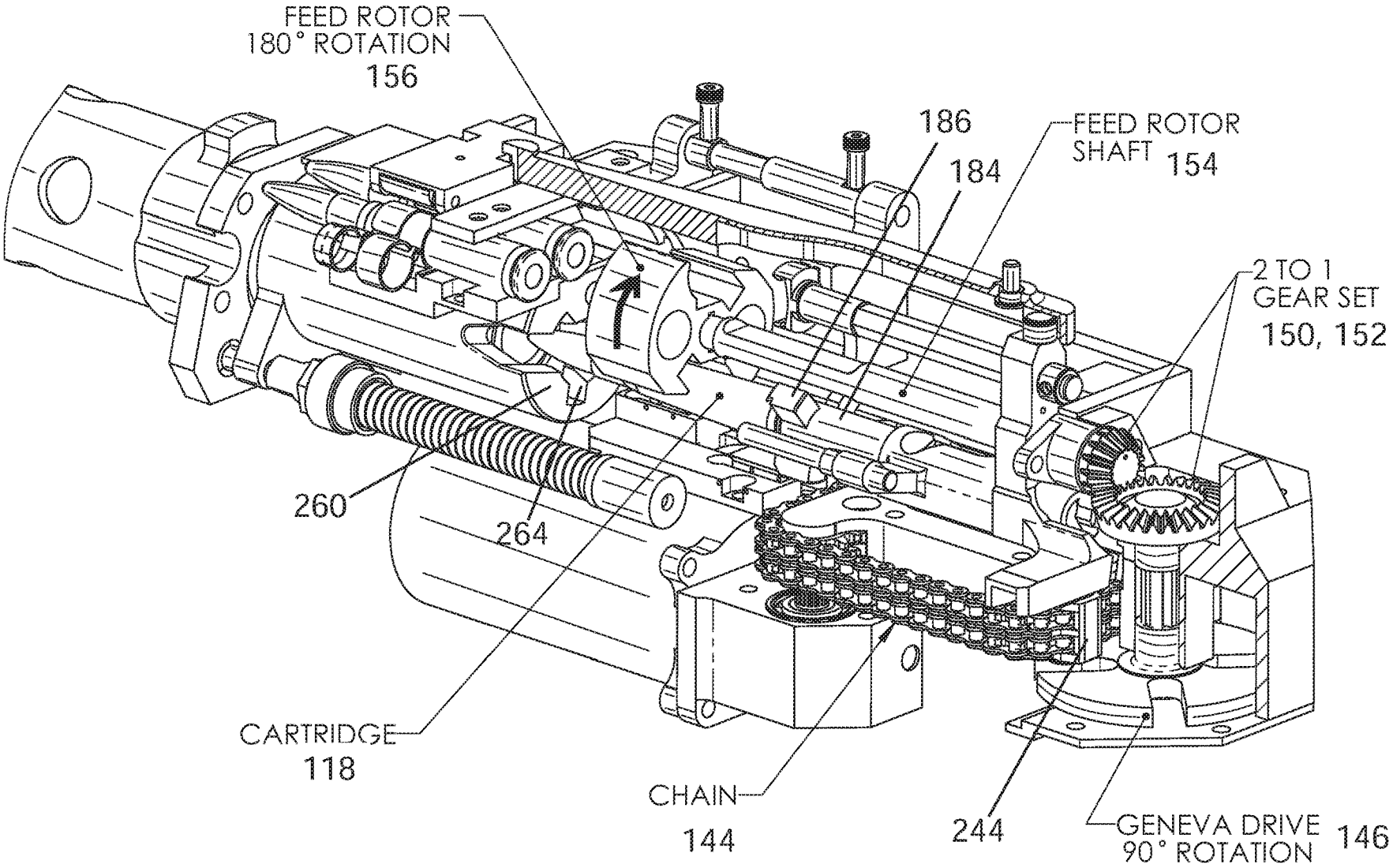

FIGS. 10A and 10B is a view after rotation of the feed rotor 156 to move the delinked cartridge 118 in line with the bolt 184 and into position to be chambered. The system components are dimensioned such that the rear flange of the cartridge 118 is captured by the three-pronged cartridge grasper 186 on the forward end of the bolt 184. At this point, the master link 244 on the chain 144 is once again at the rear left corner on the rectangular chain path, in position to once again drive the bolt carrier 160 and bolt 184 forward.

Figure 11:
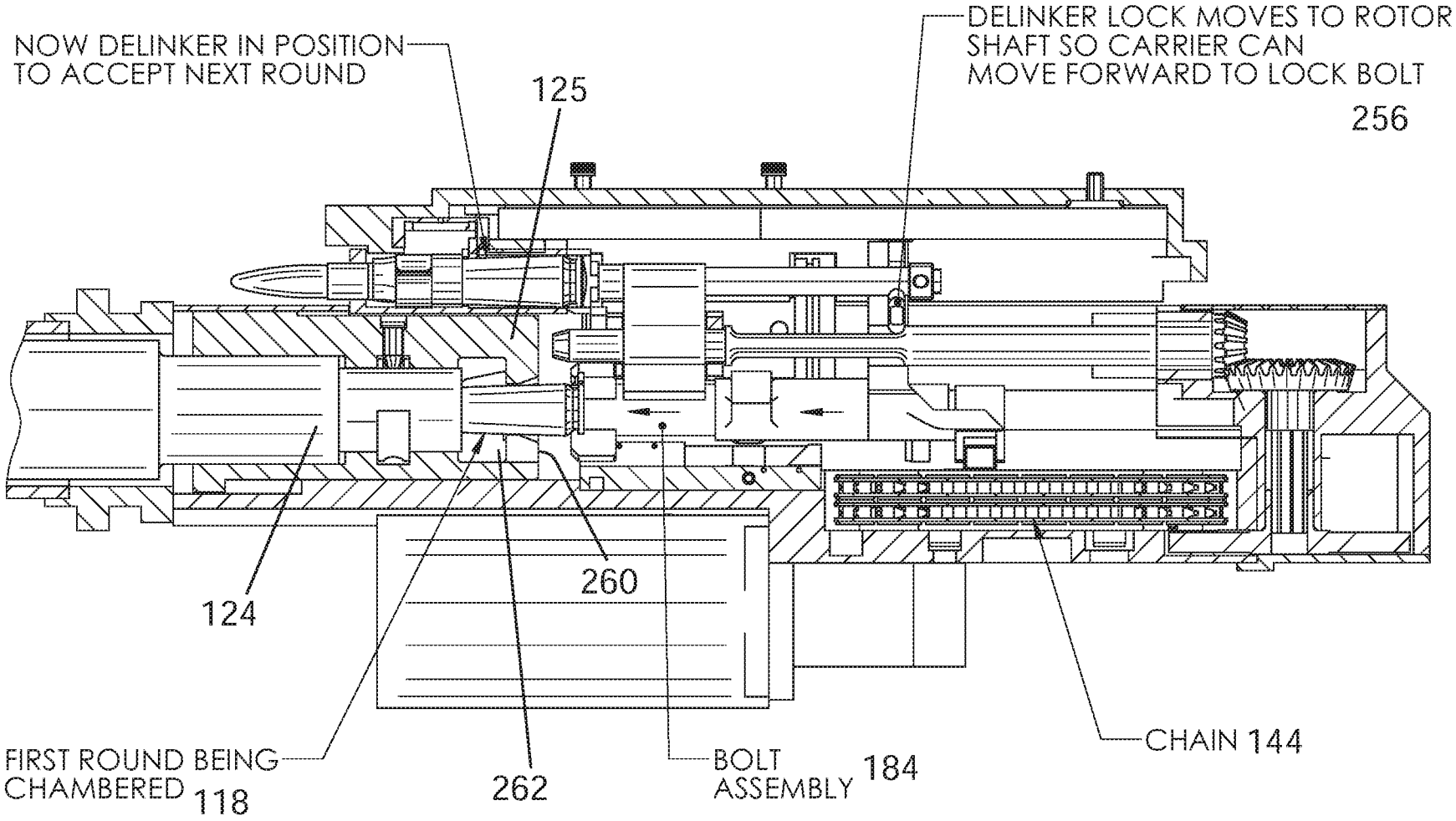
FIG. 11 is a longitudinal sectional view of the delinking and firing mechanism during an operation step of a first round being chambered.

FIG. 11 is a longitudinal sectional view of the delinking and firing mechanism during an operation step of a first round 118 being chambered. The bolt carrier 160 and bolt 184 are moved forward by the chain 144 which pushes the cartridge 118 through the breech 125 into the chamber 124. This is essentially a repeat of the step of FIG. 4A, though with a cartridge 118 now being chambered. The breech 125 has a tapered lead-in aperture on its rear wall 260 leading to an expanded cavity 262 within the breech. As seen in FIG. 10B, the rear face 260 has three irregular lugs or cutouts 264 emanating outward from the central tapered lead-in aperture that permit passage of the three-pronged cartridge grasper 186 on the bolt 184.

Figure 12A:
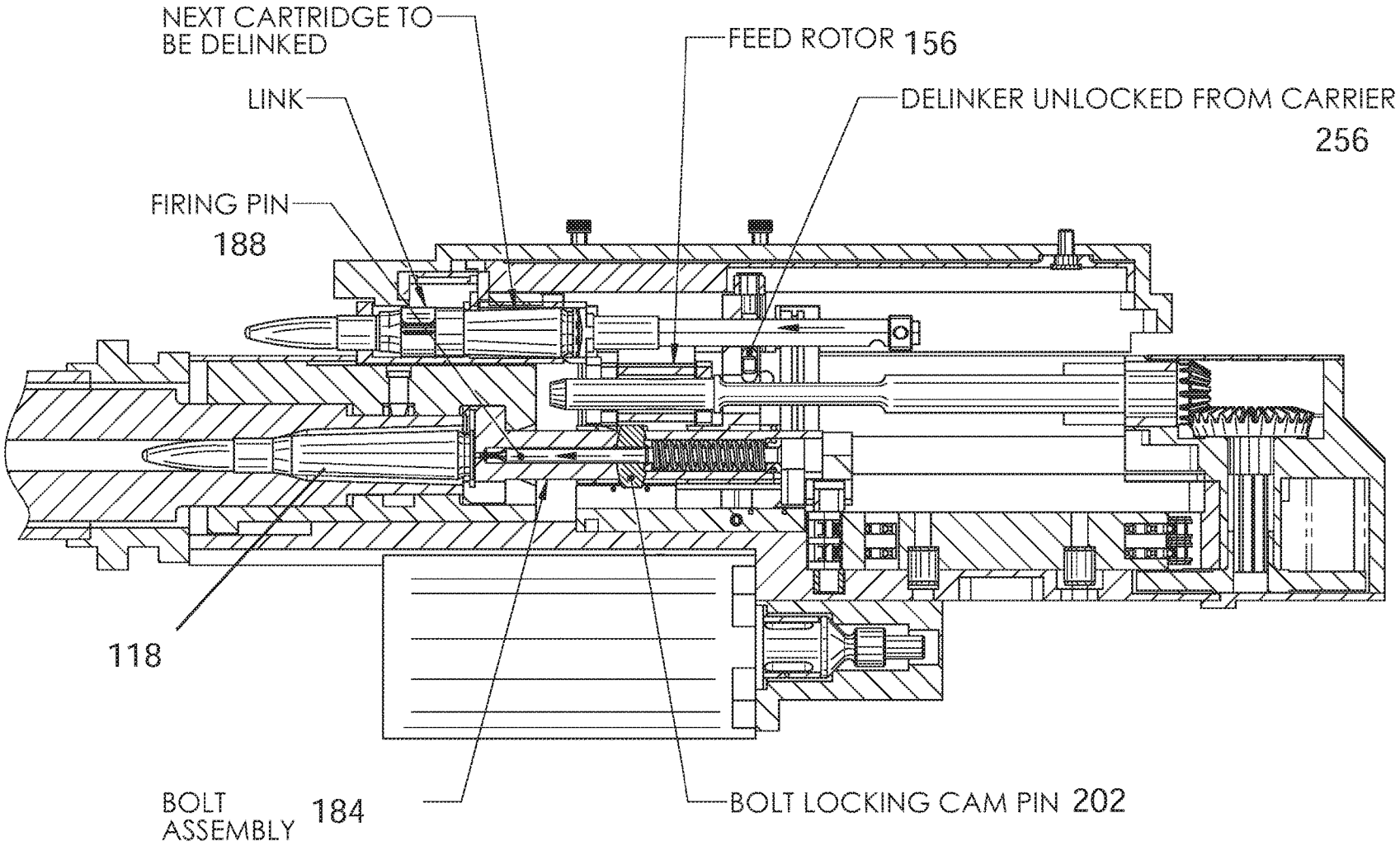
FIG. 12A is a longitudinal sectional view and FIG. 12B is a cutaway perspective view of the delinking and firing mechanism with the round fully chambered and showing the delinker moved forward into position to engage the second round in the belt.
Figure 12B:
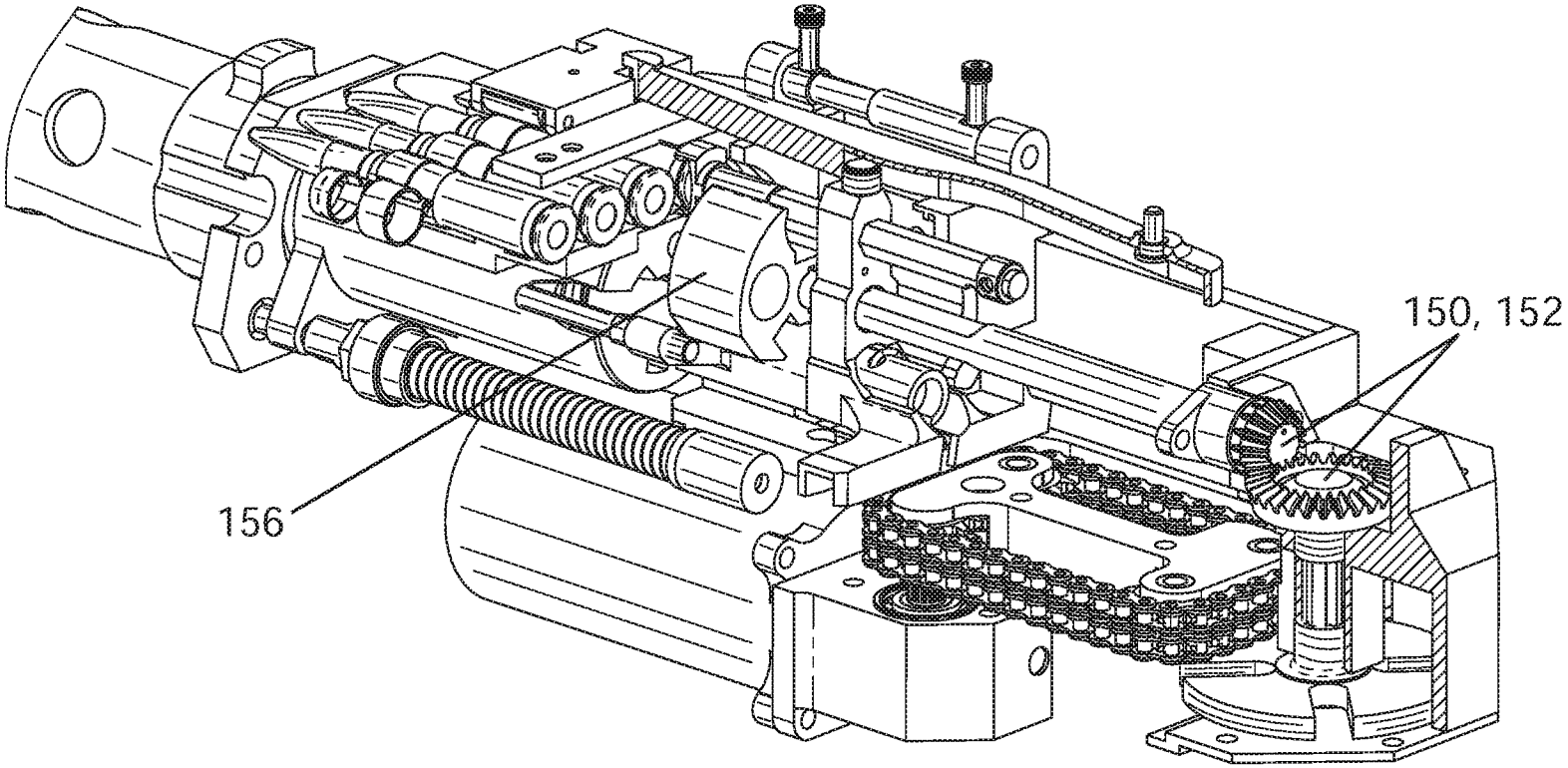
Figure 13:
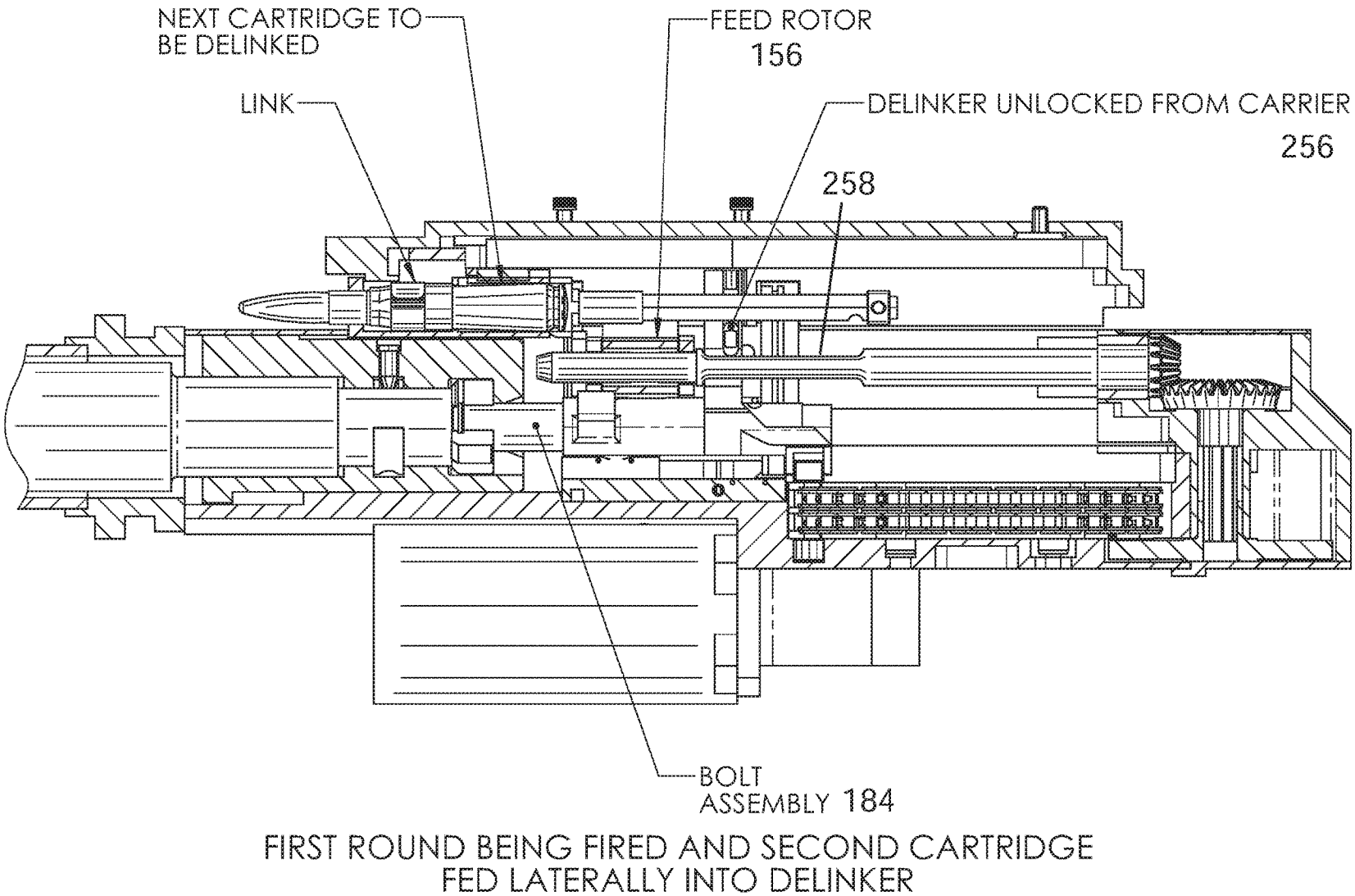
FIG. 13 is a longitudinal sectional view of the delinking and firing mechanism during an operation step of a first round being fired and a second cartridge being fed to the delinker.

Ultimately, FIGS. 12A and 12B show the round 118 fully chambered. FIG. 13 shows a first round being fired and a second cartridge 118 being fed to the delinker. Reference to FIGS. 17-20 is once again necessary.

Figure 14:
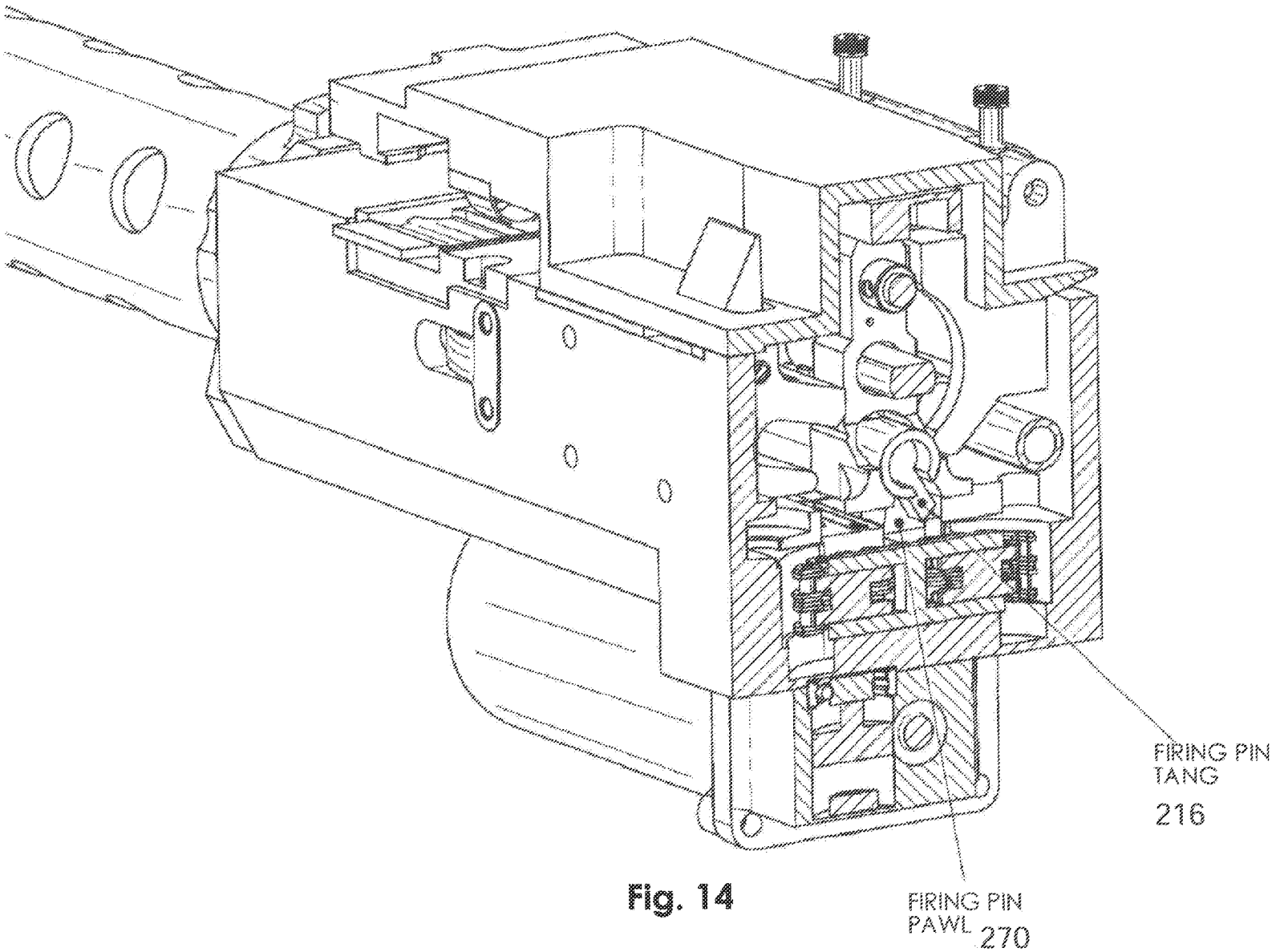
FIG. 14 is a perspective view cutaway along a lateral vertical section through the delinking and firing mechanism showing a rear end of the bolt assembly and an anti-hang fire mechanism that eliminates the hazards of a delayed functioning, or hangfire, of a fired round of ammunition.

The rear end of the firing pin 188 includes a laterally-extending tang 216 that slides within a slot 219 in the lower rear end of the bolt carrier 160 (FIG. 18B) and within a slot 218 (FIG. 20A) formed in a rear end of the bolt 184. As the bolt carrier 160 and bolt 184 move forward, a laterally-extending tang 216 at the rear of the firing pin 188 eventually contacts a fixed pawl 270 within the receiver 112, as seen in FIG. 14. Prior to this contact, the firing pin 188 is carried along within the bolt 184 by virtue of the interactions of the spring 190, collar 210 and groove 212. The pawl 270 temporarily prevents further forward movement of the firing pin. However, the rest of the bolt 184 and carrier assembly continues forward a short distance, about ½ inch. During this movement, collar 210 which is locked to the firing pin 188 by a circlip in groove 212 (see FIG. 20C) is pulled back from its position against the cam pin 202 (see FIG. 19B), which compresses the firing pin spring 190.

Contact between the front end of the bolt 184 and the rear of the breech 125 occurs just prior to full forward travel of the bolt carrier 160, driven by the chain 144. That is, the bolt carrier 160 continues to move forward after the bolt 184 stops. The three-pronged cartridge grasper 186 on the bolt 184 passes through the aligned cutouts 264 and contacts the rear of the barrel 124. The bolt 184 then stops moving linearly but is forced to rotate by relative sliding movement of the bolt carrier 160 and its longitudinal tube 162 thereover. Further longitudinal movement of the longitudinal tube 162 and specifically the cam slots 204 therein act on the cam pin 202.

With reference to FIGS. 18B and 19A, the cam slots 204 are angled to rotate the cam pin 202 and bolt 184 a small angular amount, which causes the bolt 184 to rotate to a locked position. That is, the three-pronged cartridge grasper 186 rotates to a position behind the rear wall 260 within the expanded cavity 262, thus sealing the cartridge within the breech 125. Specifically, the cam pin 202 initially resides in the forward angled portions 206 of the carrier cam slots 204. As the carrier 160 moves forward, the cam pin 202 is guided by the angled portions 206 toward the longitudinally-oriented portions of the cam slots 204, thus rotating the cam pin 202 and bolt 184.

This does two things. First, the three-pronged cartridge grasper 186 on the bolt 184 is rotated in the cavity 262 behind the rear wall 260 of the breech 125, thus locking the bolt and breech together. Secondly, the firing pin tang 216 rotates out of engagement with the pawl 270 and into the slot 218 (FIG. 20A), freeing up the firing pin to launch forward. As it is released by the pawl 270, the firing pin 188 snaps forward under the built-up force of the spring 190. Full compression of the firing pin spring 190 is attained just as the bolt 184 is rotated to its fully locked position. Simultaneous rotation of the firing pin tang 216 off the firing pin pawl 270 permits the firing pin 188 to spring forward such that the forward nose 196 pistons through the firing pin bore 194 and strikes the primer of the round, causing it to fire.

Following firing of a cartridge, the chain 146 continues to turn and eventually pulls the carrier 160 back to the rear. This rotates the bolt 184 to an unlocked position through a reverse camming sequence between the cam slots 204 and the cam pin 202, until the carrier 160 again moves linearly in synch with the bolt 184. The bolt 184 pulls the spent cartridge shell free from the breech 125 whereupon it is ejected via a mechanism that will not be described herein.

In the rear cartridge removal system described herein, the delinker is slidably attached to the bolt and carrier assembly so that its travel can be controllably timed and limited in relation to the motion of the bolt assembly. The delinker shaft is hexagonal in cross section to prevent rotation, and passes through a mating hexagonal hole in the bolt carrier. The forward and aft position of the delinker is controlled by a vertically sliding pin which engages a recess in the hex shaft and also rides against the outside of the rotor shaft which is parallel to the delinker. The rotor and rotor shaft are fixed in the fore and aft direction but rotate to deliver rounds from the delinker to the bolt during the feed process.

As the bolt and carrier assembly move forward to the firing and feeding position, the front of the delinker contacts the back of the feed tray. At the same time the vertically positioned locking pin is allowed to move out of its holding position and to move downward into a recess in the feed rotor shaft. In doing so it is decoupled from the motion of the bolt and carrier assy. That assembly is now free to continue forward and to lock and fire. At the same time as that is happening, the feed cam is moving a shuttle to feed the next round into the delinker for the next cycle.

After firing, the bolt assembly moves to the rear, free from the delinker until a collar on the aft end of the delinker shaft contacts the back of the bolt carrier and the locking pin which had been cammed into the rotor shaft is cammed back into the delinker shaft. At this point the delinking of the new round is started and the round is pulled back into a cavity in the feed rotor, ready to be rotated down into the bolt face.

Anti Hangfire System

In the past certain externally powered guns have incorporated an anti-hangfire system to protect the gunner and the gun itself from the disastrous effects of the delayed functioning or hangfire of a fired round of ammunition. Since an externally powered gun does not depend upon the gas pressure or the recoil force of the fired round to function the mechanism, it can open the breech/bolt mechanism prior to the functioning of the round. If the round fires at that time the explosive force will not be container within the gun but will blow powder and case fragments out of the gun in possibly hurt the gunner and the weapon itself. To prevent this, a system was previously disclosed in U.S. Pat. No. 4,301,709 through the use of a somewhat complex linkage system, and a solenoid was capable of preventing the possibility of a hang fire damaging the gunner or the system itself. While this system functioned well it was complex and required very close tolerances, was prone to malfunctions and was costly to build and difficult to integrate into the gun mechanism.

The anti-hang fire system presented here does away with all of the mechanical moving parts associated with the old system and replaces them with a single electronic proximity sensor and a logic circuit, working in conjunction with an already existing gun part, the firing pin.

FIG. 14 is a perspective view cutaway along a lateral vertical section through the delinking and firing mechanism showing a rear end of the bolt assembly and an anti-hang fire mechanism that eliminates the hazards of a delayed functioning, or hangfire, of a fired round of ammunition.

FIGS. 15A-15D are enlarged views of a rear end of a firing pin and firing pin tang which rotates to ensure that there is no delayed functioning, or hangfire, of a fired round of ammunition.

The functioning of this system is described as follows:

Located in the receiver below the tang 216 of the firing pin 188, and at the end of its forward travel is a proximity sensor 272 which can sense the presence of the firing pin tang. The only time it can sense the tang is at the moment of primer strike. It is therefore a positive indication of the attempt to fire the round. Simultaneously, a 0.006 second timer is started in the logic circuit.

At this point one of two things occur. Either the round fires or it does not fire. If the round fires, the combination of barrel breech 125 and bolt 184 and firing pin 188 recoils towards the rear of the gun. This immediately moves the firing pin tang 216 away from the sensor 272 in the receiver 212 which remains stationary relative to the recoiling parts. This turns off the sensor 272 which tells the logic circuit that the round has fired, the timer is shut off, and the gun continues to fire.

The second thing that can happen is that the round does not fire and the barrel etc. does not recoil. The tang 216 of the firing pin 188 thus stays within the sensing distance of the proximity sensor 272. In this case the timer times out and the logic circuit shuts off the drive motor and initiates a dynamic brake to immediately stop the gun prior to the opening of the breech 125. The dwell of the bolt and carrier assembly in the locked position is sufficiently long to allow this to happen without the possibility of the bolt opening.

The use of the firing pin tang 216 as the principle indicator of the status of the firing of the gun eliminates the need for five mechanical parts, two springs, and a solenoid plus associated extra machining of the receiver and other parts, plus the space weight and power of the system, further reducing the overall gun size.

An adjunct to the above system is anticipated in the case of a gun which does not have a recoil system. In that case the firing pin 188 would not move away from the proximity sensor 272 upon firing. In that case an accelerometer would be attached to the receiver to sense the existence of a firing pulse. The firing pulse is significantly different than other accelerations experienced by the parent vehicle. In addition, only accelerations felt immediately after [within 0.006 sec] the firing pin tang is sensed by the proximity sensor 272 would be considered. All other acceleration signals will be filtered out by the logic circuit.

Those skilled in the art will appreciate that various changes and modifications may be made to the preferred embodiments, the invention in its broader aspects is not limited to the specific details, representative devices, and illustrative examples shown and described.

It is claimed:

1. A method of operating a rearward-stripping externally-powered gun, the gun having a receiver at the rear end of a longitudinal barrel, the receiver having a motor and motor drive system and being configured to laterally receive a plurality of cartridges held within a series of connected links with a rear base of the cartridges facing to the rear, the method comprises:

driving a bolt carrier longitudinally forward and rearward by the motor drive system, the bolt carrier having a longitudinal tube and tower extending perpendicularly away from the tube, a bolt being positioned within the longitudinal tube of the bolt carrier and having a forward end with a cartridge grasper adapted to engage the rear base of a cartridge, the bolt being aligned with a breech and chamber of the barrel;

translating the cartridges laterally through the receiver;

translating a delinker shaft arranged in the receiver longitudinally toward and away from the cartridges held within the connected links, the delinker shaft having a forward end adapted to engage the rear base of a cartridge and remove one cartridge at a time from the connected links, the delinker shaft passing through a delinker bore in the bolt carrier tower, wherein the delinker shaft is coupled by a lock member to periodically translate with the bolt carrier tower;

rotating a feed rotor about a longitudinal axis, the feed rotor being configured to transfer a cartridge from a delinked position engaged with the delinker shaft to a load position whereby the cartridge is engaged by the cartridge grasper of the bolt; and translating the bolt carrier forward until the delinker shaft is in position to engage the rear base of a cartridge, whereby the lock member decouples further forward translation of the delinker shaft from the bolt carrier, and the bolt carrier continues forward to displace the bolt and a cartridge engaged thereby forward and deliver the cartridge to the chamber to be fired.

2. The method of claim 1, wherein the receiver has a feed shuttle adapted to translate the cartridges laterally through the receiver, the feed shuttle being connected to be actuated by a feed cam pivoted by a feed cam roller fixed to the bolt carrier tower.

3. The method of claim 1, wherein the delinker shaft and delinker bore in the bolt carrier tower are cooperatively formed to prevent relative rotation of the delinker shaft in the delinker bore.

4. The method of claim 1, wherein the feed rotor mounts to a feed rotor shaft that is fixed longitudinally within the receiver and passes through a throughbore in the bolt carrier tower located between the delinker bore and longitudinal tube of the bolt carrier, the feed rotor shaft being rotatable within the throughbore and having oppositely-directed recessed sections therein, wherein the lock member is configured to drop into one of the recessed sections and decouple forward translation of the delinker shaft from the bolt carrier.

5. The method of claim 4, wherein the feed rotor shaft is driven by a feed rotor drive system driven by the motor drive system that periodically rotates the feed rotor to transfer a cartridge from the delinked position to the load position.

6. The method of claim 5, wherein the motor drive system is a chain drive and the feed rotor drive system includes a Geneva Drive periodically rotated by the chain drive, the Geneva Drive being connected to a gear at a rear end of the feed rotor shaft.

7. The method of claim 4, wherein the recessed sections each have a rounded rear end that cams the lock member upward into a recess in the delinker shaft and recouples translation of the delinker shaft to the bolt carrier when the bolt carrier tower moves rearward.

8. The method of claim 7, wherein the delinker shaft has a rear collar which is engaged by the delinker bore in the bolt carrier tower when the bolt carrier tower moves rearward.

9. The method of claim 1, wherein the bolt carries a firing pin in a longitudinal passage therein, the firing pin having a rear tang extending laterally therefrom, and wherein forward movement of the bolt carrier and bolt eventually causes the rear tang to contact a pawl fixed in the receiver and temporarily stop forward movement of the firing pin, the bolt further housing a firing spring which is extended when forward movement of the firing pin is temporarily stopped, the bolt carrier having a cam recess that engages and rotates a cam pin through the bolt to disengage the rear tang from the pawl and release the firing pin to move forward under influence of the firing spring and fire the cartridge.

10. The method of claim 9, wherein the receiver has a proximity sensor located adjacent a slot at a rear end of the bolt carrier and in a path of movement of the rear tang, wherein the rear tang actuates the proximity sensor, and the receiver contains an electric circuit and logic with a timer, wherein the logic circuit is configured to shut off the drive motor and initiate a dynamic brake to immediately stop the gun prior to opening of the breech if the rear tang does not move away from the proximity sensor within a predetermined time period.

11. The method of claim 1, wherein the receiver has a receiver mounting length RML defined as the distance from the rear base of each incoming cartridge in the connected links to the rear end of the receiver that is less than 15 inches.

12. A method of operating a rearward-stripping externally-powered gun, the gun having a receiver at the rear end of a longitudinal barrel, the receiver having a motor and motor drive system and being configured to laterally receive a plurality of cartridges held within a series of connected links with a rear base of the cartridges facing to the rear, the method comprises:

driving a bolt carrier longitudinally forward and rearward with the motor drive system, the bolt carrier carrying a bolt having a forward end with a cartridge grasper adapted to engage the rear base of a cartridge, the bolt being aligned with a breech and chamber of the barrel;

translating the cartridges laterally through the receiver;

translating a delinker shaft longitudinally forward and rearward with the bolt carrier, the delinker shaft having a forward end adapted to engage the rear base of a cartridge and remove one cartridge at a time from the connected links when translated rearward, the delinker shaft being coupled by a movable lock member to periodically translate with the bolt carrier, wherein the bolt carrier translates the delinker shaft forward until the delinker shaft is in position to engage the rear base of a cartridge, whereby the lock member moves and decouples further forward translation of the delinker shaft from the bolt carrier, and the bolt carrier continues forward to displace the bolt and a cartridge engaged thereby forward and deliver the cartridge to the chamber to be fired; and periodically rotating a feed rotor about a longitudinal axis with the motor drive system, the feed rotor being configured to transfer a cartridge from a delinked position engaged with the delinker shaft to a load position whereby the cartridge is engaged by the cartridge grasper of the bolt.

13. The method of claim 12, wherein the receiver has a feed shuttle adapted to translate the cartridges laterally through the receiver, the feed shuttle being connected to be actuated by a feed cam pivoted by a feed cam roller fixed to the bolt carrier.

14. The method of claim 12, wherein the bolt carrier has a longitudinal tube and tower extending perpendicularly away from the tube, the bolt being positioned within the longitudinal tube, and the delinker shaft passes through a delinker bore in the bolt carrier tower and is prevented from relative rotation therein.

15. The method of claim 14, wherein the feed rotor mounts to a feed rotor shaft that is fixed longitudinally within the receiver and passes through a throughbore in the bolt carrier tower located between the delinker bore and longitudinal tube of the bolt carrier, the feed rotor shaft being rotatable within the throughbore and having oppositely-directed recessed sections therein, wherein the lock member is configured to drop into one of the recessed sections and decouple forward translation of the delinker shaft from the bolt carrier.

16. The method of claim 15, wherein the feed rotor shaft is driven by a feed rotor drive system driven by the motor drive system that periodically rotates the feed rotor to transfer a cartridge from the delinked position to the load position.

17. The method of claim 16, wherein the motor drive system is a chain drive and the feed rotor drive system includes a Geneva Drive periodically rotated by the chain drive, the Geneva Drive being connected to a gear at a rear end of the feed rotor shaft.

18. The method of claim 15, wherein the recessed sections each have a rounded rear end that cams the lock member upward into a recess in the delinker shaft and recouples translation of the delinker shaft to the bolt carrier when the bolt carrier tower moves rearward.

19. The method of claim 18, wherein the delinker shaft has a rear collar which is engaged by the delinker bore in the bolt carrier tower when the bolt carrier tower moves rearward.

20. The method of claim 12, wherein the bolt carries a firing pin in a longitudinal passage therein, the firing pin having a rear tang extending laterally therefrom, and wherein forward movement of the bolt carrier and bolt eventually causes the rear tang to contact a pawl fixed in the receiver and temporarily stop forward movement of the firing pin, the bolt further housing a firing spring which is extended when forward movement of the firing pin is temporarily stopped, the bolt carrier having a cam recess that engages and rotates a cam pin through the bolt to disengage the rear tang from the pawl and release the firing pin to move forward under influence of the firing spring and fire the cartridge.

21. The method of claim 20, wherein the receiver has a proximity sensor located adjacent a slot at a rear end of the bolt carrier and in a path of movement of the rear tang, wherein the rear tang actuates the proximity sensor, and the receiver contains an electric circuit and logic with a timer, wherein the logic circuit is configured to shut off the drive motor and initiate a dynamic brake to immediately stop the gun prior to opening of the breech if the rear tang does not move away from the proximity sensor within a predetermined time period.

22. The method of claim 12, wherein the receiver has a receiver mounting length RML defined as the distance from the rear base of each incoming cartridge in the connected links to the rear end of the receiver that is less than 15 inches.

* * * * *